US005583523A

United States Patent [19]

Wallace, Jr.

[11] Patent Number: 5,583,523

[45] **Date of Patent: * Dec. 10, 1996**

[54] PLANAR MICROWAVE TRANCEIVER EMPLOYING SHARED-GROUND-PLANE ANTENNA

[75] Inventor: Walter B. Wallace, Jr., Roseville, Calif.

[73] Assignee: C & K Systems, Incorporation, Folsom, Calif.

[ * ] Notice: The term of this patent shall not extend beyond the expiration date of Pat. No. 5,371,509.

[21] Appl. No.: 426,465

[22] Filed: Apr. 19, 1995

Related U.S. Application Data

[63] Continuation of Ser. No. 209,842, Mar. 11, 1994, abandoned, which is a continuation-in-part of Ser. No. 131,857, Oct. 4, 1993, Pat. No. 5,371,509, which is a continuation of Ser. No. 817,339, Jan. 6, 1992, abandoned.

[51] Int. Cl.[6] ..... H01Q 11/12

[52] U.S. Cl. ..... 343/741; 343/700 MS; 343/866

[58] Field of Search ..... 343/741, 700 MS, 343/855, 866, 728, 729, 725, 829, 832, 845, 846, 848; 340/553; H01Q 11/12, 9/04, 9/06, 9/16, 9/26, 7/00

[56] References Cited

U.S. PATENT DOCUMENTS

| | | | |
|---|---|---|---|
| 3,925,774 | 12/1975 | Amlung | 343/795 |
| 4,142,190 | 2/1979 | Kerr | 343/840 |
| 4,195,301 | 3/1980 | Conroy | 343/840 |
| 4,644,361 | 2/1987 | Yokoyama | 343/700 MS |
| 4,710,750 | 12/1987 | Johnson | 340/522 |
| 4,801,944 | 1/1989 | Madnick et al. | 343/741 |
| 4,853,703 | 8/1989 | Murakami et al. | 343/700 MS |
| 4,994,820 | 2/1991 | Suzuki et al. | 343/846 |
| 5,023,594 | 6/1991 | Wallace | 340/552 |
| 5,371,509 | 12/1994 | Wallace, Jr. et al. | 343/741 |

FOREIGN PATENT DOCUMENTS

| | | | |
|---|---|---|---|
| 2171257 | 8/1986 | United Kingdom | H01O 21/10 |
| 2217112 | 10/1989 | United Kingdom | H01Q 1/38 |
| 2217122 | 10/1989 | United Kingdom | H01R 4/64 |

OTHER PUBLICATIONS

Smith, *Loop Antennas,* Antenna Engineering Handbook, §5 (McGraw Hill, Johnson and Jasik, 2d ed. 1984) no month.

G. Vendelin, *Design of Amplifiers and Oscillators by the S-parameter Method* (Wiley, 1982).

G. Vendelin, *Microwave Circuit Design* (Wiley, 1990). No month.

Brochure, "DR02980 Series Transceiver ", Alpha Industries of Woburn, Massachusetts, Mar. 1991.

*Primary Examiner*—Hoanganh T. Le

*Attorney, Agent, or Firm*—Limbach & Limbach

[57] ABSTRACT

A preferred embodiment of an antenna for radiating and collecting electromagnetic radiation includes a substantially planar conductive member having a first side and a second side. A strip conductor is positioned to the first side of the conductive member and substantially parallel thereto. A dielectric material is sandwiched between the strip conductor and the conductive member. A length of wire for radiating and collecting microwave electromagnetic radiation has a first end and a second end and lies substantially in a plane which is positioned to the second side of the conductive member and substantially parallel thereto. The length of wire is spaced apart a distance from the conductive member. A feed probe wire couples the first end of the length of wire to the strip conductor. The feed probe wire extends through the conductive member and through the dielectric material. A shorting wire couples the second end of the length of wire to the conductive member.

41 Claims, 17 Drawing Sheets

PLANAR MICROWAVE TRANCEIVER EMPLOYING SHARED-GROUND-PLANE ANTENNA

CROSS REFERENCE TO RELATED APPLICATION

This is a continuation of application Ser. No. 08/209,842 filed on Mar. 11, 1994 now abandoned; which was a continuation-in-part application of Ser. No. 08/131,857 filed Oct. 4, 1993, now issued as U.S. Pat. No. 5,371,509; which was a continuation of application Ser. No. 07/817,339 filed Jan. 6, 1992, now abandoned.

BACKGROUND OF THE INVENTION

1. Field of the Invention

The present invention relates to motion detectors, and more particularly, to a planar microwave transceiver and antenna.

2. Description of the Related Art

Area protection sensors and/or intrusion detection systems, such as those used in burglar alarms, typically include presence and/or motion detectors. Two general types of detectors are used: passive and active. An example of a passive detector is a passive infrared detector which detects the presence and/or motion of infrared radiation within a defined area to be protected.

An example of an active detector is a transceiver. The transceiver transmits and receives some form of radiation to detect the presence and/or motion of an object within the defined area to be protected. One example is an acoustic transceiver which transmits and receives acoustic radiation (e.g., ultrasonic, SONAR) to perform its detection function. Another example is a microwave transceiver transmits and receives microwave radiation (typically frequencies greater than 1 Gigahertz) to perform its detection function.

A microwave transceiver typically generates microwave radiation by way of a waveguide cavity oscillator. The microwave radiation is radiated into free space by way of a waveguide horn antenna (See FIG. 1). The transceiver and horn antenna are often contained in a plastic housing which is mounted on the wall of a dwelling or building to be protected. While the waveguide cavity oscillator and horn antenna effectively generate, radiate, and collect microwave radiation, they suffer from the disadvantage of being physically large and heavy. Thus, the plastic housings which contain the transceivers and horn antennas are rather bulky in order to accommodate the considerable physical dimensions of the components. When mounted on the wall of a home or place of business, these bulky plastic housings are quite noticeable and detract from the aesthetics of the area to be protected. It has become clear in the intrusion detection device market that consumers prefer a smaller and more compact unit which is less conspicuous.

The waveguide cavity oscillator and horn antenna also suffer from the disadvantage of being expensive to produce. Waveguide oscillators generally use Gunn diodes as the active oscillator device. Gunn diodes are specialized devices which makes them expensive. Horn antennas and waveguide oscillator cavities are expensive because they are usually manufactured by a casting process. Naturally, consumers prefer a unit which has a low cost.

Hence, a compelling need has emerged for a more compact and inexpensive microwave transceiver and antenna for use in intrusion detection systems.

SUMMARY OF THE INVENTION

The present invention provides an antenna for radiating and collecting electromagnetic radiation. The antenna includes a substantially planar conductive member having a first side and a second side. A strip conductor is positioned to the first side of the conductive member and substantially parallel thereto. A dielectric material is sandwiched between the strip conductor and the conductive member. A length of wire for radiating and collecting microwave electromagnetic radiation has a first end and a second end and lies substantially in a plane which is positioned to the second side of the conductive member and substantially parallel thereto. The length of wire is spaced apart a distance from the conductive member. A feed probe wire couples the first end of the length of wire to the strip conductor. The feed probe wire extends through the conductive member and through the dielectric material. A shorting wire couples the second end of the length of wire to the conductive member.

Another embodiment of the inventions provides a microwave antenna that includes a substantially planar substantially conductive member having a first side and a second side. A length of wire for radiating and collecting microwave electromagnetic radiation has a first end and a second end and lies substantially in a plane which is substantially parallel to the conductive member and spaced apart a distance from the first side of the conductive member. The conductive member reflects microwave electromagnetic radiation radiated from the length of wire. A feed probe wire has a first end thereof electrically coupled to the first end of the length of wire. The feed probe wire extends through the conductive member. A shorting wire couples the second end of the length of wire to the conductive member.

Another embodiment of the present invention provides a microwave antenna that includes a strip conductor transmission line having a conductive ground plane positioned spaced apart and substantially parallel to the strip conductor transmission line and having a dielectric material sandwiched therebetween. A length of wire has a first end coupled to the strip conductor transmission line and a second end coupled to the conductive ground plane. The length of wire radiates and collects electromagnetic radiation and lies substantially in a plane which is substantially parallel to the ground plane of the strip conductor. The length of wire shares the ground plane with the strip conductor by being positioned spaced apart a distance from the ground plane such that the ground plane is capable of reflecting electromagnetic radiation radiated by the wire. The ground plane functions as a ground plane for the strip conductor and as a reflector for the length of wire.

Another embodiment of the present invention provides an apparatus for transmitting and receiving electromagnetic radiation. A microwave transceiver for transmitting and receiving electromagnetic energy has a piece of dielectric material sandwiched between a ground plane and a strip conductor transmission line which is substantially parallel to the ground plane. The strip conductor transmission line is located on a first side of the piece of dielectric material. The strip conductor transmission line is capable of carrying the transmitted and received electromagnetic energy. A wire antenna radiates and collects electromagnetic radiation and has a first end and a second end. The wire antenna first end is electrically coupled to the strip conductor transmission line and the wire antenna second end is electrically coupled to the ground plane. The wire antenna is positioned spaced apart from the ground plane of the transceiver so that the wire antenna shares the ground plane with the transceiver as a reflective surface.

Another embodiment of the present invention provides a method of matching the impedance of a wire antenna to the impedance of a strip conductor transmission line. The strip conductor transmission line is spaced apart from a ground plane and has a dielectric material sandwiched therebetween. The wire antenna lies substantially in one plane and is capable of radiating and collecting electromagnetic radiation having a predetermined frequency and wavelength. The method includes the steps of: setting the length of the wire antenna initially approximately equal to one wavelength of the radiated electromagnetic radiation; positioning the wire antenna a distance spaced apart from the ground plane of the strip conductor such that the plane of the wire antenna is substantially parallel to the ground plane; coupling a first end of the wire antenna to the strip conductor transmission line by way of a feed probe wire, a length of microstrip transmission line, and a capacitor, the feed probe wire having a selected length and extending through the ground plane and through the dielectric material; coupling a second end of the wire antenna to the ground plane by way of a shorting wire; and, adjusting the length of the wire antenna and the distance between the ground plane and the wire antenna until the impedance of the wire antenna is matched to the impedance of the strip conductor transmission line.

A better understanding of the features and advantages of the present invention will be obtained by reference to the following detailed description of the invention and accompanying drawings which set forth an illustrative embodiment in which the principals of the invention are utilized.

DETAILED DESCRIPTION OF THE PREFERRED EMBODIMENTS

One way to make a more compact intrusion detection device is to integrate a microwave transceiver that is smaller than the waveguide cavity oscillator with a microwave antenna that is smaller than the waveguide horn antenna. Integrating these two smaller components to produce a compact, inexpensive, and effective intrusion detection device has simply not been feasible in the past.

Figure 1:
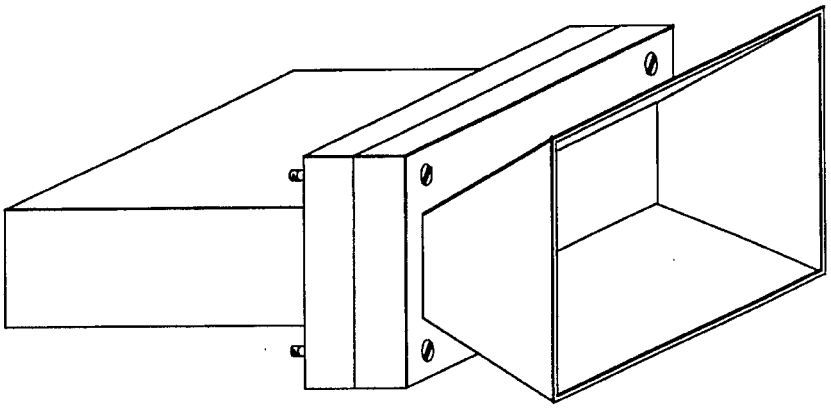
FIG. 1 (PRIOR ART)
FIG. 1 is a perspective of a prior art microwave transceiver and horn antenna.
Figure 2:
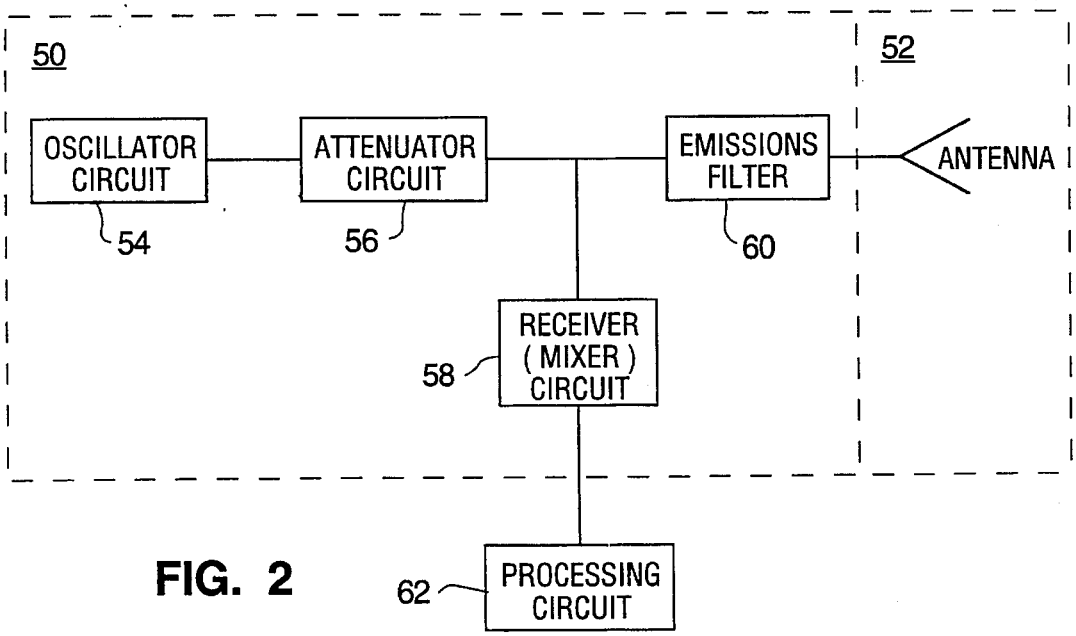
FIG. 2 is a functional block diagram of a preferred embodiment of the present invention.

FIG. 2 illustrates a functional block diagram of a preferred embodiment of a planar microwave transceiver 50 and a microwave antenna 52 in accordance with the present invention. The planar microwave transceiver 50 is more compact than a waveguide cavity oscillator. One reason for its compact size is that it utilizes a microstrip transmission line, rather than a waveguide, to carry microwave electromagnetic energy. While the planar microwave transceiver 50 utilizes a microstrip transmission line, it should be understood that other strip conductor transmission lines, such as stripline, may be used.

Microstrip line consists of a strip conductor, a conductive ground plane, and a dielectric material sandwiched between the strip conductor and the conductive ground plane. The side of the dielectric material which has the strip conductor on it resembles a printed circuit board. The components used for generating and receiving microwave energy are mounted on this side of the dielectric material and are coupled to the strip conductor. The other side of the dielectric material has only the conductive ground plane on it. Thus, the planar microwave transceiver is a flat device which can be contained in a narrow housing.

The planar microwave transceiver 50 is generally less expensive to produce than a waveguide cavity oscillator. One reason for the reduced cost is that a high-frequency silicon bipolar transistor can be used as the active oscillator device rather than a Gunn diode. A high-frequency silicon bipolar transistor is considerably less expensive than a Gunn diode. Thus, the cost and compact size of the planar microwave transceiver make it a desirable device for use in a compact intrusion detection device.

The planar microwave transceiver 50 includes a microwave electromagnetic energy generator circuit 54 coupled to an attenuator circuit 56. The attenuator circuit 56 is coupled to both a receiver circuit 58 and an emissions filter circuit 60. All of these components are mounted on a planar piece of dielectric material and are coupled to one another via microstrip line. The microwave antenna 52 is coupled to the output of the emissions filter 60. The planar microwave circuit 50 and the microwave antenna 52 are contained in a compact housing which will be described below.

During operation, intrusion detection is accomplished in the following manner. The generator circuit 54 generates microwave electromagnetic energy for transmission at a transmission frequency. The transmission frequency, which is generally in the lower portion of the microwave frequency band, preferably falls within the S Band and is about 2.45 GHz. The generated energy propagates to the attenuator circuit 56 where the power of the generated energy is reduced before the energy is delivered to the receiver circuit 58 and the emissions filter circuit 60. The power of the generated energy is reduced for two reasons: 1) to avoid over-driving the receiver circuit 58, and 2) to provide isolation between the generator circuit 54 and the receiver circuit 58. Isolation between these two circuits prevents frequency-pulling of the generator circuit 54 by the impedance presented by the receiver circuit 58. In other words, by reducing the power of the generated energy each time it travels through the attenuator circuit 56, adverse effects to the generator circuit 54 can be avoided due to any energy reflected back by the receiver circuit 58 or due to radiation collected by the antenna 52 which propagates through the emissions filter 60 to the receiver circuit 58.

After attenuation, generated energy propagates along microstrip line to both the receiver circuit 58 and the emissions filter circuit 60. The emissions filter circuit 60 reflects the undesired second, third, and fourth harmonic content of the generated microwave energy. The reflected energy is dissipated in the attenuator circuit 56 such that it is substantially shunted to ground reference. The undesired harmonics of the generated radiation must be removed in order to comply with Federal Communications Commission (FCC) requirements.

After the undesired harmonics are removed, the fundamental frequency of the generated energy propagates to the microwave antenna 52 where it is radiated into free space. If an object or body is present in the field pattern of the antenna 52, the object will reflect radiation back to the antenna 52. If the object is moving towards or away from the antenna 52, a Doppler Shift will occur and the reflected radiation will have a slightly different frequency than the generated radiation. The reflected radiation is collected by the microwave antenna 52.

The collected energy propagates along microstrip line to the receiver circuit 58. The receiver circuit mixes the collected energy with the generated energy and produces an Intermediate Frequency (IF) signal. The IF signal has a frequency equal to the difference between the frequencies of the generated and collected electromagnetic energy. The IF signal is then sent to processing circuitry 62 which analyzes the signal to determine if an intrusion has occurred.

Figure 3:
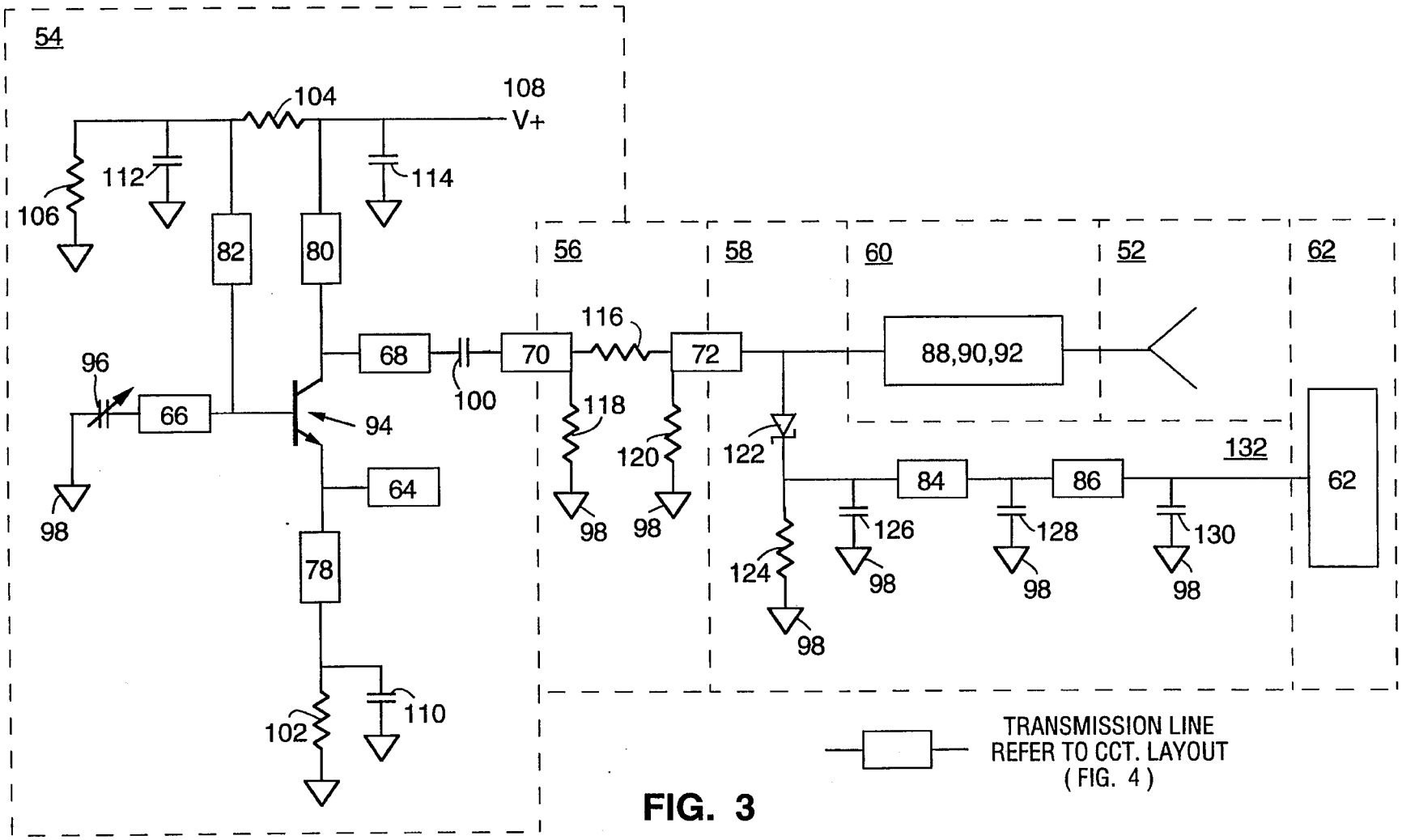
FIG. 3 is a schematic diagram characterization of a preferred embodiment of the planar microwave transceiver of the present invention.
Figure 4:
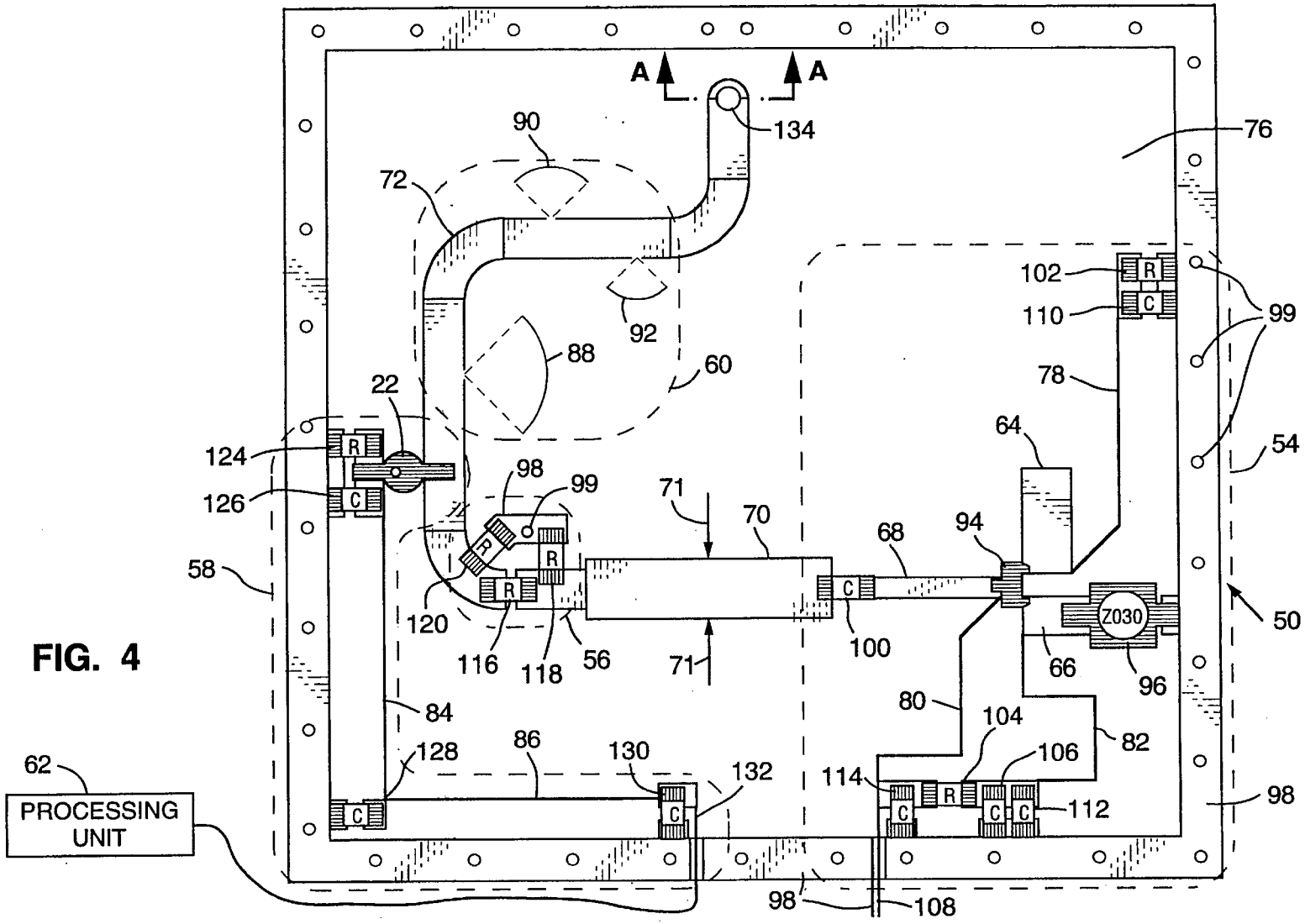
FIG. 4 is an approximately three to one blow-up of a printed circuit board layout of a preferred embodiment of the planar microwave transceiver of the present invention.

Referring simultaneously to FIGS. 3 and 4, a detailed description of the structure and operation of the compact planar microwave transceiver 50 will now be provided.

As mentioned above, the planar microwave transceiver 50 uses microstrip line to carry microwave energy from one component to the next. Microstrip line is a microwave component which is in effect a single wire transmission line operating above ground. Microwave energy is able to propagate along microstrip line due to the electric and magnetic fields which occur in the dielectric material between the strip conductor and the ground plane. Therefore, microstrip line employs the combination of the strip conductor, dielectric material, and ground plane in order to function.

Microstrip is itself a microwave circuit component (or element) which, depending upon its physical dimensions and the frequency of the energy, may have resistive, capacitive, and/or inductive properties. The thickness and width of the strip conductor, the thickness of the dielectric material, and the dielectric constant of the dielectric material all determine the properties that the microstrip will exhibit. Thus, the physical dimensions of each microstrip component are important to the circuit's functioning properly.

In the planar microwave transceiver 50, strip conductors 64, 66, 68, 70, 72, 78, 80, 82, 84, 86, 88, 90, and 92 are etched from a sheet of metal bonded to a dielectric material 76. It is important to note that most of these strip conductors each serve a different function which will be discussed in detail below (e.g., strip conductor 72 is primarily a transmission line, strip conductors 88, 90, and 92 are filters, and strip conductor 64 is a capacitive stub). The strip conductors may be etched on a copper-clad dielectric circuit board (such as a double sided board) using techniques well known in the art. It is preferred to use grade 65M80 copper-clad dielectric circuit board manufactured by Westinghouse of Sylmar, Calif.; this board has a dielectric thickness of 0.059±0.004 inches and a copper thickness of 0.0014 inches (1 oz./sq.ft.).

A conductive ground plane 74 (See FIG. 5) is bonded to the opposite side of dielectric material 76. A DC and AC ground 98 is connected to be at a common potential to the ground plane 74 by means of via holes 99 which extend through the dielectric material 76. The via holes 99 are located around the circuit perimeter and near the attenuator resistors 118 and 120.

FIG. 4 is an approximately three to one scale blow up of the actual printed circuit board layout of the planar microwave transceiver 50. In the preferred embodiment the actual width of the strip conductor 70 indicated by the arrows 71 is 0.140 inches. Because FIG. 4 is a scale drawing, this information can be used to determine the actual dimensions of the rest of the microstrip components.

The rectangular blocks shown in the schematic diagram characterization of FIG. 3, such as blocks 64, 66, 68, 70, and 72, represent the various different portions of microstrip line in the circuit and are shown in order to illustrate the nature of the effect each portion of microstrip line has on the operation of the circuit.

The microwave electromagnetic energy generator circuit 54 relies primarily on a high frequency silicon bipolar transistor 94 to generate the microwave energy. The transistor 94 is configured in such a manner that it functions as an oscillator. By way of example, a model MMBR941L high frequency silicon bipolar transistor manufactured by Motorola of Phoenix, Ariz., may be used for transistor 94. A GaAs transistor may also be used as an alternative for the transistor 94. A silicon bipolar transistor is preferred because of its low cost and availability.

The emitter of the transistor 94 is coupled to an emitter capacitive stub 64 which, as mentioned above, comprises a piece of microstrip. The base of the transistor 94 is coupled to a trimmer capacitor 96 by way of a base stub 66. Trimmer capacitor 96 is coupled between the base stub 66 and DC and AC ground potential 98. By way of example, a 1.5–3.0 picofarad model TZB04Z030AB chip trimmer capacitor manufactured by muRata ERIE of State College, Pa., may be used for the trimmer capacitor 96. A varactor diode is an example of an alternative device that may be used in place of the trimmer capacitor 96. When a varactor diode is used, a conventional biasing circuit should be provided to select the desired capacitance to be provided by the varactor diode.

The collector of the transistor 94 is connected to a collector resonator transmission line 68 which is connected to a collector resonator transmission line 70 by a DC block capacitor 100. The collector resonator transmission lines 68 and 70 are used to carry the generated microwave electromagnetic energy to the rest of the planar microwave circuit 50.

The emitter voltage of the transistor 94 is set by an emitter resistor 102. The base voltage is determined by a voltage divider circuit comprised of base resistor 104 and base resistor 106. The emitter and base resistors 102 and 106 are terminated at DC and AC ground potential 98. A positive DC voltage is supplied to the collector of the transistor 94 via a power line 108 and high impedance microstrip line 80.

In order to prevent the bias network from affecting the microwave performance of the microwave generator circuit 54, RF chokes are connected to the emitter, base, and collector of the transistor 94. The RF chokes are each comprised of a high-impedance microstrip line connected to a bypass capacitor which is terminated at DC and AC ground potential 98. The RF choke for the emitter of the transistor 94 includes a high impedance microstrip line 78. Bypass capacitor 110 is connected in shunt between high impedance microstrip line 78 and ground. The RF choke for the base of the transistor 94 includes a high impedance microstrip line 82 which couples the junction of resistors 104 and 106 to the base of transistor 94. High impedance microstrip line 82 also couples capacitor 112, which is connected in shunt between the junction of resistors 104 and 106 and ground, to the base of transistor 94. The RF choke for the collector of the transistor 94 includes a bypass capacitor 114 which is connected in shunt between high impedance microstrip line 80 and ground.

Figure 6A:
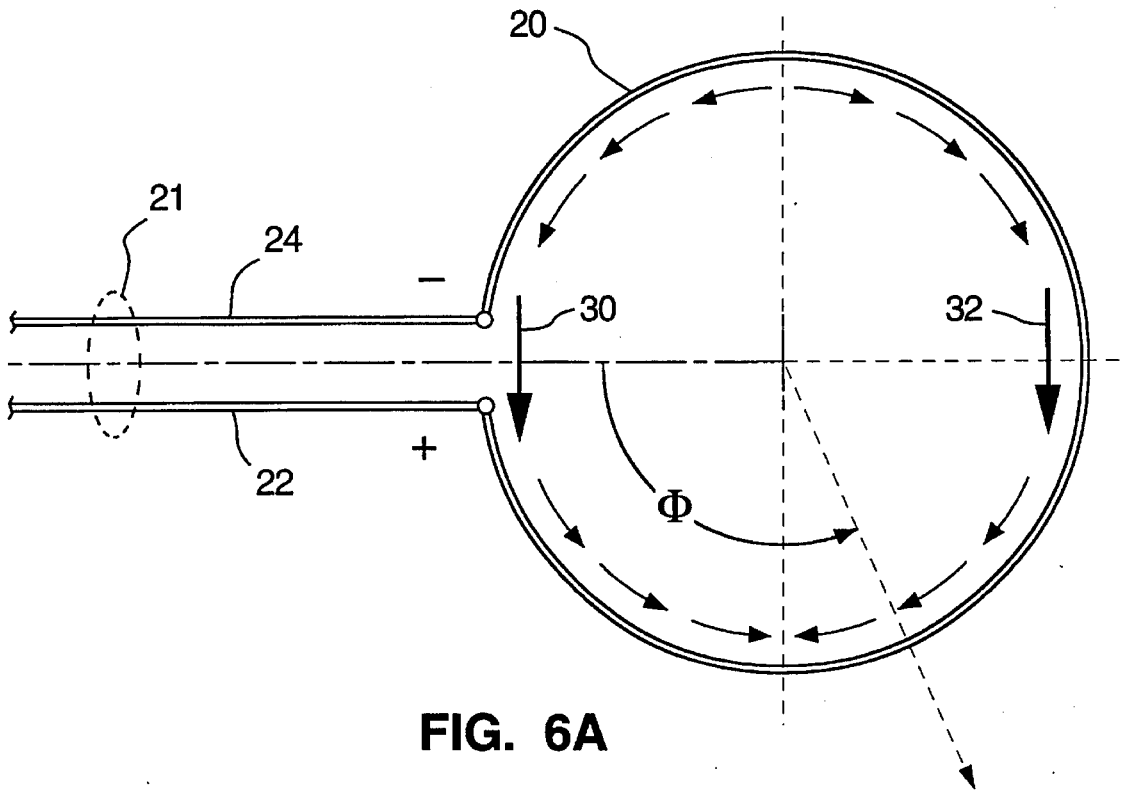
FIGS. 6(*a*) and 6(*b*) are diagrams of a standard loop antenna which is fed with a balanced twin line feed line.
Figure 6B:
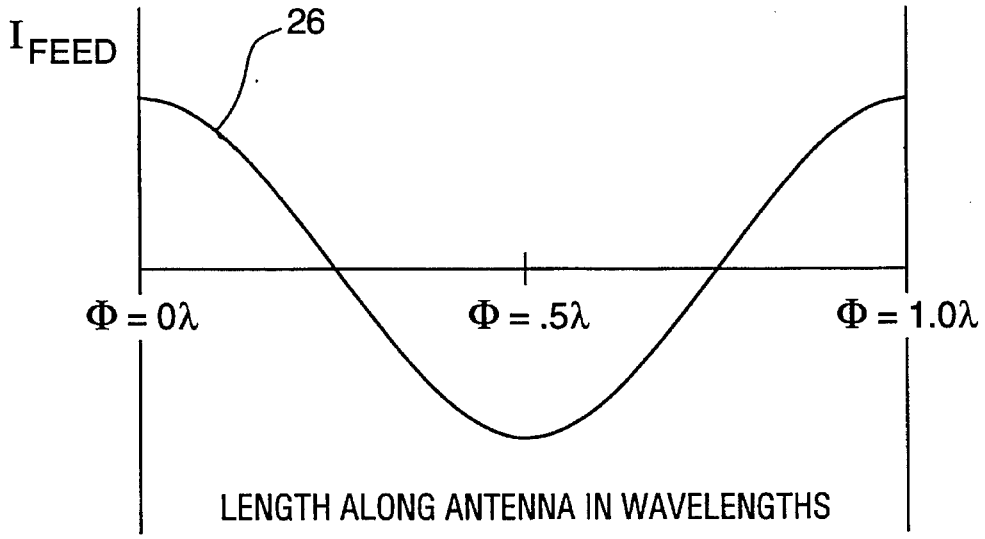

The RF chokes each appear as an open circuit to the emitter, base, and collector of the transistor 94 at the operating frequency of the oscillator circuit. This follows from the fact that the high impedance microstrip lines 78, 80, and 82 each reflect the nearly short circuit impedance of each of the bypass capacitors 110, 112, and 114 to an equivalent open circuit at the transistor 94. For this reflection to be optimal, each of the high impedance lines 78, 80, and 82 must have the appropriate length, which can be derived from the measured reflection coefficient of the capacitors and common Smith Chart calculations which are well known in the art. Generally, this length is about 0.25 times the operating frequency wavelength. Preferred lengths can also be derived from FIG. 4. Furthermore, the impedance of the high-impedance lines 78, 80, and 82 is determined by their width, as well as the other factors used to determine the properties of microstrip line (discussed above). The impedance of each of the high impedance lines 78, 80, and 82 shown in FIG. 6 is about 110 ohms.

The S-Parameter method of oscillator design is used to determine the frequency of the electromagnetic energy that is generated by the generator circuit 54. The frequency of the microwave electromagnetic energy that is generated by the generator circuit 54 is primarily determined by the S-Parameters of the transistor 94 and its associated microwave elements. The associated microwave elements are the collector resonator transmission lines 68 and 70, the emitter capacitive stub 64, the base stub 66, the DC block capacitor 100, and the trimmer capacitor 96. If these elements are constructed in accordance with the dimensions illustrated in FIG. 4, the S-Parameters will be set such that the transmission frequency of the generated electromagnetic energy will be about 2.450 GHz.

The value of the transmission frequency can be further fine tuned by adjusting the capacitive value of the trimmer capacitor 96. This fine tuning mechanism can be used to compensate for variations in the transistor 94 and variations in the dielectric material 76.

The generated microwave energy propagates away from the generator circuit 54 along the collector resonator transmission line 68. The generated energy is coupled to the collector resonator transmission line 70 through a capacitor 100. Capacitor 100 is a DC blocking capacitor. The generated energy then propagates along the collector resonator transmission line 70 to the attenuator circuit 56.

The attenuator circuit 56 is comprised of a common resistive pi-network design. An attenuator resistor 116 is coupled in series between the collector resonator transmission line 70 and a main transmission line 72. A second attenuator resistor 118 is coupled between the collector resonator transmission line 70 and DC and AC ground potential 98. A third attenuator resistor 120 is coupled between the main transmission line 72 and DC and AC ground potential 98. Using the resistance values shown in Table I below, the power of the generated microwave energy will be reduced by about 6 dB each time it propagates through the attenuator circuit 56. Therefore, if the receiver circuit 58 reflects any generated energy back, the power of the reflected energy will be reduced by about 12 dB by the time it gets to the generator circuit 54. This 12 dB of isolation between the receiver circuit 58 and the generator circuit 54 eliminates the need for a buffer amplifier to prevent adverse effects on the microwave performance of the generator circuit 54 by the reflected energy. This further reduces the complexity and the cost of the transceiver of the present invention.

The dimensions of the microstrip which forms the main transmission line 72, which can be derived from FIG. 4, are such that its impedance is approximately 50 ohms. This 50 ohm impedance is the value which is to be matched to the impedance of the microwave antenna 52, which will be discussed below.

After attenuation, the generated microwave energy propagates along the main transmission line 72 to the receiver circuit 58. The main component of the receiver circuit 58 is a Schottky-barrier diode 122. By way of example, a model MA4CS102A N-type medium-barrier Schottky diode manufactured by M/A-COM of Burlington, Mass., may be used for the diode 122. This diode has the following specifications: Vf=0.36 V typ. @ 1 mA, CT=1.0 pF max., Rd=8Ω typ. @ 5 mA. The anode of the diode 122 is coupled to the main transmission line 72. The cathode of the diode 122 is coupled to a resistor 124 which is used to provide a leakage path to DC ground for static voltage on the diode 122. The resistor 124 has a value of 1.2 Kohms. The cathode of the diode 122 is also coupled to a bypass capacitor 126 which is used to provide AC grounding of the diode 122 cathode.

The cathode of the diode 122 is further coupled to two sections of RF choke circuitry similar to that used in the generator circuit 54. Specifically, a high impedance microstrip line 84 is coupled to a bypass capacitor 128. The bypass capacitor 128 is connected in shunt between high impedance microstrip line 84 and ground. Another high impedance microstrip line 86 is coupled to high impedance line 84. A bypass capacitor 130 is connected in shunt between high impedance microstrip line 86 and ground. This circuitry functions as a two stage low pass filter.

During operation, the generated microwave energy switches the diode 122 at the transmission frequency. When received energy (i.e., radiation collected by the antenna 52) is present on the main transmission line 72, it is mixed with the generated energy due to the non-linear electrical properties of the diode 122. This mixing produces an Intermediate Frequency (IF) signal which is the difference between the generated and received energy. The frequency of this IF signal will usually be in the range 1 to 30 Hz.

The IF signal then propagates through the high impedance lines 84 and 86 to processing unit 62 via output line 132. Any microwave energy propagated by the diode 122 is rejected by high impedance lines 84 and 86 and capacitors 128 and 130. This reduces the noise bandwidth. The processing unit 62 may be intrusion detection circuitry which is well known in the art. Such circuitry analyzes the IF signal and detects whether an intrusion (e.g., presence or motion of an object) has occurred within the spatial region irradiated by the transmitted radiation.

The generated energy continues to propagate along the main transmission line 72 to the emissions filter 60. The emissions filter 60 is a series of low-pass filter structures which comprise three radial open microstrip stubs 88, 90, and 92. The stubs 88, 90, and 92 are designed to reflect the second, third, and fourth harmonic content of the generated microwave energy back to the attenuator circuit 56. These undesired harmonics are then attenuated and thereby substantially shunted to ground.

After passing through the emissions filter 60, the energy of the fundamental transmission frequency of the generated microwave energy propagates to a feed-through via hole 134 which is a plated-through hole at the end of the main transmission line 72. The feed-through hole 134 extends completely through the dielectric material 76 and through the conductive ground plane 74 (See FIG. 5). The ground plane is spaced a distance away from the feed-through hole 134 to prevent contact between them. The feed-through hole 134 is the point where the main transmission line 72 is coupled to the microwave antenna 52. The impedance of the microwave antenna 52 is to be matched to the impedance of the main transmission line 72 at the feed-through hole 134.

Figure 5:
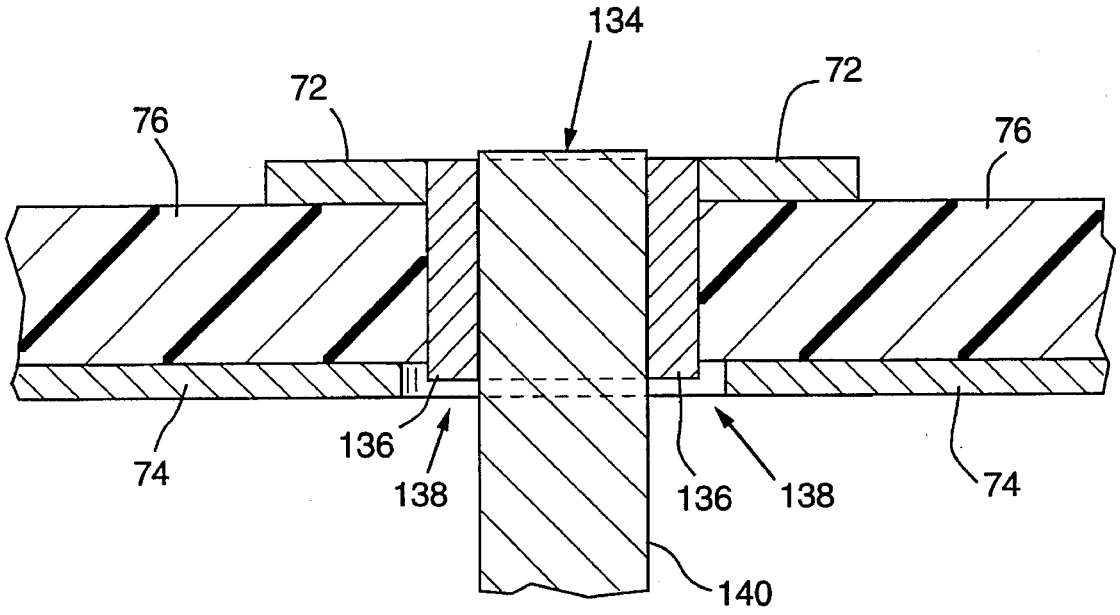
FIG. 5 is an expanded cross-sectional view of a section of the printed circuit board of FIG. 4 taken along line A—A.

Referring to FIG. 5, there is illustrated an expanded cross-sectional view of the via feed-through hole 134 of FIG. 4 taken along line A—A. The walls on the interior of the feed-through hole 134 are lined with a conductive wall 136 which is electrically coupled to the main transmission line 72. There is a gap 138 separating the ground plane 74 and the conductive wall 136 so that no contact is made therebetween. A portion of the feed probe wire 140 for the microwave antenna 52, which will be discussed below, is also shown inserted into the feed-through hole 134.

The microwave transceiver 50 is constantly receiving microwave radiation while it is simultaneously transmitting. During reception, the microwave antenna 52 collects radiation which is in turn coupled to the main transmission line 72. This received energy then propagates to the receiver circuit 58 in a manner reciprocal to that previously described for transmitted energy.

In the preferred embodiment of the present invention, the discrete resistors and capacitors have values set forth in Table I. The resistors are all ⅛ Watt, 5% tolerance, model CR1206 package chip resistors manufactured by Bourns Co. of Riverside, Calif. The capacitors are all model GRM42-6COG680J50V chip capacitors manufactured by muRata ERIE of State College, Pa.

TABLE I

| Component | Value |
|---|---|
| Resistor 102 | 100Ω |
| Resistor 104 | 3.3 KΩ |
| Resistor 106 | 3.9 KΩ |
| Resistor 116 | 39Ω |

TABLE I-continued

| Component | Value |
|---|---|
| Resistor 118 | 150Ω |
| Resistor 120 | 150Ω |
| Resistor 124 | 1.2 KΩ |
| Capacitor 100 | 68.0 picofarad |
| Capacitor 110 | 68.0 picofarad |
| Capacitor 112 | 68.0 picofarad |
| Capacitor 114 | 68.0 picofarad |
| Capacitor 126 | 68.0 picofarad |
| Capacitor 128 | 68.0 picofarad |
| Capacitor 130 | 68.0 picofarad |

While the planar microwave transceiver 50 appears to be a desirable substitute for the waveguide cavity oscillator, difficulties arise when integrating it with a microwave antenna to produce a small and inexpensive assembly. As already mentioned, a waveguide horn antenna occupies too much space. Furthermore, its large size makes it impractical for use in the lower portion of the microwave frequency band (the portion where the planar microwave transceiver operates). The horn antenna requires the use of a complex feed structure which increases the number of circuit components, increasing size and cost. Reflector type antennas suffer from the same drawbacks.

One antenna that was considered for integration with the planar microwave transceiver 50 is the printed circuit antenna, or "patch" antenna. A patch antenna is basically an extension of the microstrip transmission line, and thus, it can easily be contained in a narrow housing. Patch antennas, however, have the drawback that they are susceptible to dielectric variations of the circuit board material, and thus, require the use of expensive, tightly toleranced circuit board material, or complex and costly tuning or broad-banding techniques. Furthermore, if the patch antenna is constructed on the same circuit board as the planar microwave transceiver 50, the circuit board must be nearly doubled in size because the patch antenna requires a substantial portion of ground plane separate from the transceiver 50. If the patch antenna is designed to "share" the ground plane of the microwave transceiver 50, then a separate circuit board for the patch antenna must be fastened to the circuit board of the microwave transceiver 50; the two circuit boards should have the planar surfaces of their ground planes fastened together. For these reasons the patch antenna was found not to be a practical alternative for a compact and inexpensive intrusion detection device.

Another antenna that was considered for integration with the planar microwave transceiver 50 is the standard loop antenna. A standard loop antenna is a piece of conductive wire which lies in one plane and has a "loop" shape. The term "loop" means that the conductive wire is bent into the shape of a closed curve, such as a circle or square, with a gap in the conductor to form the terminals. The standard loop antenna, however, was found to have drawbacks when integrated with the planar microwave transceiver 50.

The standard loop antenna suffers from the drawback that it must be fed with a balanced twin line feed transmission line. In a balanced twin line the currents in the two conductors are of equal amplitude and opposite phase. If the standard loop antenna is to be used with a transceiver which has only a single unbalanced transmission line available, then a balun circuit must be added to convert the single line transmission line into a balanced twin line. The addition of a balun circuit adds additional size and cost and is not a practical solution in the development of a compact and inexpensive intrusion detection device.

In order to understand why a standard loop antenna must necessarily be fed with a balanced twin line feed, one must first understand the basic concept of matching the impedance of the antenna to the transmission line, and second, one must understand the basic operation of a standard loop antenna.

Maximum power will be transferred from a transmission line to an antenna if the magnitude of the impedance of the transmission line is equal to the magnitude of the input impedance of the antenna, assuming that the impedance of the transmission line and antenna is purely real (i.e., contains zero reactive component). The input impedance of an antenna is the ratio at its terminals, where the transmission line is to be connected, of voltage to current. If a high current is present at the terminals, then the input impedance will be lower than if a low current is present at the terminals.

Many times, as in the case of the standard loop antenna, the input impedance of the antenna must be reduced in order to match the antenna to the impedance of the available transmission line. The input impedance of the antenna can be reduced by tuning the antenna to have a high current present at its terminals. Additionally, if the antenna is tuned to resonate at the operating frequency, the input impedance will be a pure resistance; otherwise, it will also have a reactive component.

FIG. 6(*a*) illustrates a standard circular loop antenna 20 which is fed with a balanced twin line feed 21 provided by lines 22 and 24. The standard circular loop antenna will operate at resonance if the length of the wire is about equal to one or more wavelengths at the operating frequency. The loop antenna 20 has a length of about one wavelength as illustrated by FIG. 6(*b*).

Line 22 of the twin line is coupled to the positive terminal of the wire loop 20, and line 24 is coupled to the negative terminal of the wire loop 20. FIG. 6(*b*) illustrates a waveform of the current which flows in the wire loop 20. Waveform 26 illustrates the current set up by line 22 of the twin line feed. Current maximums occur in the wire loop at $\Phi$ equal to 0° and 180°; arrows 30 and 32 indicate the direction of the current flow at these maximum points. Current nodes (i.e., minimum current points) occur at $\Phi$ equal 90° and 270°. Arrows 30 and 32 illustrate that the current in the standard loop antenna is roughly equivalent to the current in a pair of parallel dipole antennas driven in phase and with spacing approximately equal to the diameter of the loop.

Figure 7A:
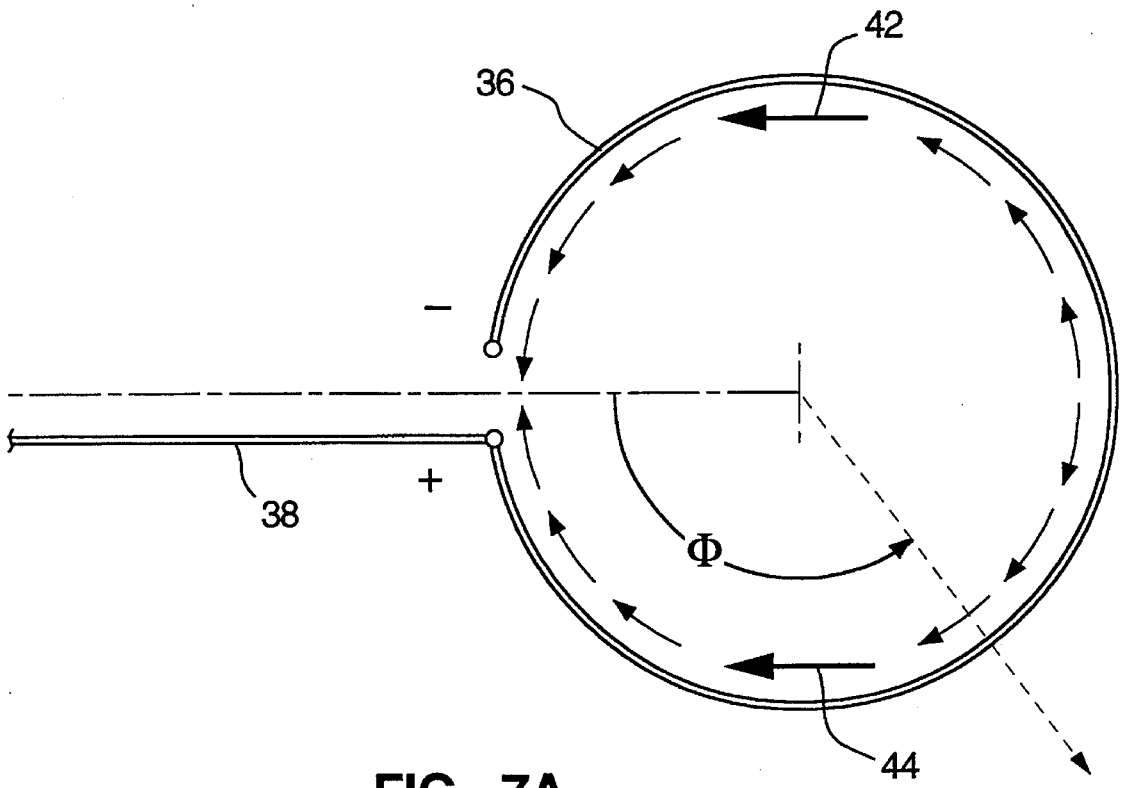
FIGS. 7(*a*) and 7(*b*) are diagrams of a standard loop antenna which is fed with a single line feed line.
Figure 7B:
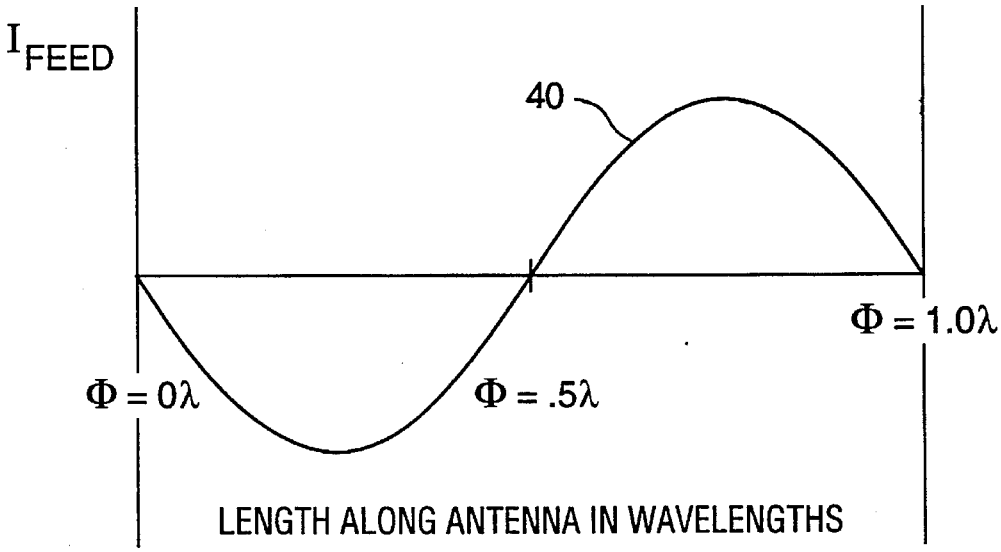

Because a current maximum occurs at the input terminals of the loop antenna 20, the input impedance is relatively low and can be easily matched to a transmission line. If a balanced twin line feed transmission line were not used, however, there would not be a current maximum at the input terminals of the loop antenna 20. This phenomenon is illustrated by FIG. 7(*a*) which shows a standard loop antenna 36 with only a single feed transmission line 38 coupled to the positive antenna input terminal. Waveform 40 of FIG. 7(*b*) illustrates the current which flows through the wire loop 36.

Because the negative input terminal of the wire loop 36 is open circuited, a current node exists at that point. The open circuit reflects microwave energy travelling in the wire loop 36 which sets up a standing wave in the loop. It follows that since the length of wire loop 36 is about one wavelength, then a current node exists at the positive input terminal where transmission line 38 is connected. Current maximums occur at $\Phi$ equal 90° and 270° and are illustrated by arrows 42 and 44.

The low current present at the positive input terminal results in a high input impedance of the wire loop which makes matching the impedance difficult. Matching could possibly be achieved if a high impedance transmission line were utilized. A high impedance transmission line, however, is not a practical alternative in a planar microwave transceiver where the impedance of the microstrip is dictated by the physical dimensions of the strip conductor and dielectric material, as well as the dielectric constant of the dielectric material.

Therefore, a standard loop antenna is not a practical alternative in a compact and inexpensive intrusion detection system because the standard loop requires a balanced twin line feed. A balanced twin line feed can be obtained by adding a balun circuit; however, a balun circuit would add size, complexity, and cost to the transceiver.

Figure 8:
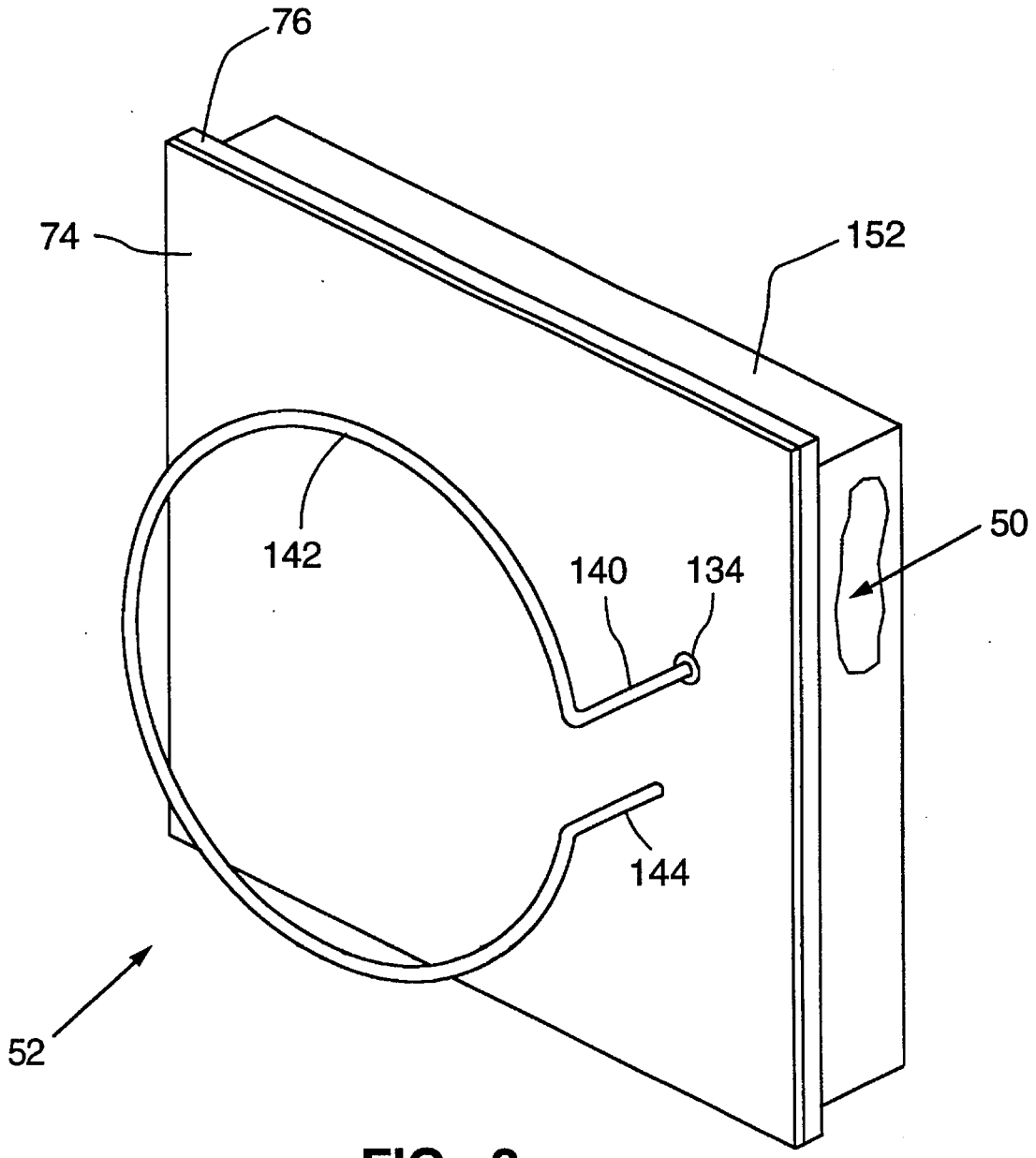
FIG. 8 is a perspective view of a preferred embodiment of the microwave transceiver and antenna of the present invention.
Figure 9B:
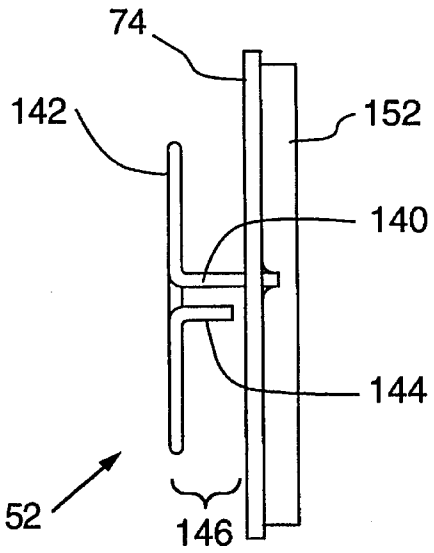
FIGS. 9(*a*), 9(*b*) and 9(*c*) are a top, end, and side view, respectively, of the microwave transceiver and antenna of FIG. 8.
Figure 9A:
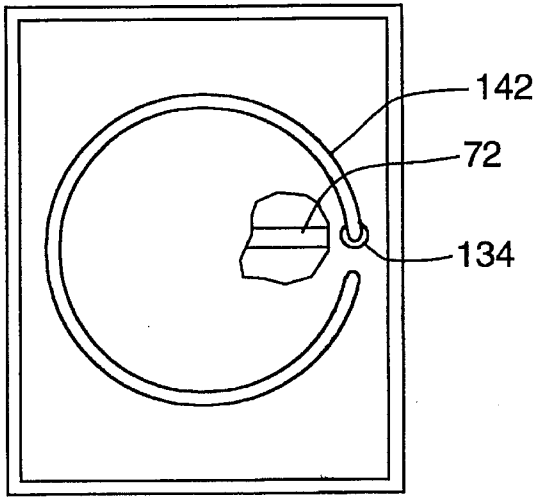
Figure 9C:
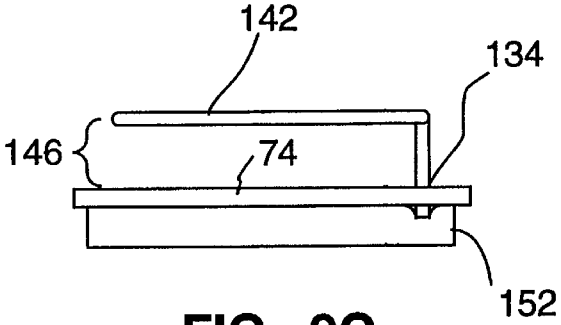

Referring to FIG. 8, there is illustrated a perspective view of a preferred embodiment of a compact microwave antenna 52 in accordance with the present invention. FIG. 9 illustrates the top, end, and side views of the antenna 52. The antenna 52 is used for radiating generated microwave electromagnetic energy and for collecting microwave radiation from free space. The antenna 52 resembles a standard loop antenna which was discussed above; however, there is a major difference between the antenna 52 and a standard loop antenna. The difference is that the antenna 52 can be fed with only a single unbalanced transmission line instead of a balanced twin line feed, and furthermore, no balun circuit is required in order to match the impedance of the antenna 52 to the single line feed. As will be seen, the antenna 52 may be connected directly to a microstrip line, stripline, or the center conductor of a coaxial line.

The antenna 52 is mounted on the opposite side of the dielectric material 76 from the microwave transceiver 50. The small cut-away section in FIG. 8 illustrates that the microwave transceiver 50 is concealed beneath an RF shield 152. The RF shield 152 encloses the microwave transceiver 50 and reduces extraneous radiation that takes place in the circuit prior to the generated energy reaching the antenna 52. Thus, the dielectric material 76 structurally supports both the antenna 52 and the planar microwave transceiver 50.

The antenna 52 includes a length of wire 142 which lies substantially in a plane which is substantially parallel to the conductive ground plane 74. The preferred type of wire to be used for the length of wire 142 is 0.050 inch diameter tin plated copper wire. It is believed that wire diameters between 0.030 and 0.070 inches may be used, the smaller diameter wires having limited mechanical rigidity, and the larger diameter wires approaching the width of the 50 ohm transmission line 72. The larger diameter wires would require a feed-through via hole 134 which is wider in diameter than the transmission line 72. The wire may be composed of any good electrically conducting metallic material or composite material that is solderable. The wire can be a non-metal material, such as a plastic, which has been plated with a conductive and solderable material.

The plane of the length of wire 142 is spaced apart a distance 146 from the conductive ground plane 74. The length of wire 142 is positioned on the opposite side of the dielectric material 76 from the planar microwave transceiver 50. In such a configuration the antenna 52 utilizes the conductive ground plane 74 as a "reflective surface"and thus "shares"the conductive ground plane 74 with the microstrip line circuitry of the planar microwave transceiver 50. Because the antenna 52 shares the conductive ground plane 74 with the planar microwave transceiver 50, a more compact intrusion detection system is obtained.

Although the length of wire 142 shown in FIG. 8 has a circular shape, it will be seen that the input impedance of the antenna 52 is relatively insensitive to the actual geometry of the length of wire 142. It is believed that impedance matching can be achieved if the length of wire 142 comprises any shape which lies substantially in a plane that is substantially parallel to the ground plane 74. The shape of the length of wire 142 may be straight, zig-zag, sinusoidal, square, rectangle, oval, triangle, or any arbitrary planar shape. The length of wire 142 does not have to form a closed shape like a standard loop antenna; the ends of the length of wire 142 may be positioned far apart. While the shape of the length of wire 142 may affect the radiation pattern of the antenna 52, the shape does not have a major impact on impedance matching. Various arbitrary shapes of the length of wire 142, however, have been found to require minor adjustment of the length of the length of wire 142 to remain optimally impedance matched.

A feed probe wire 140 is coupled to one end of the length of wire 142. The feed probe wire 140 extends into the feed-through hole 134 which extends through the ground plane 74. The feed probe wire 140 is electrically coupled to the conductive wall 136, as well as the main transmission line 72 (See FIG.7).

The point where the feed probe wire 140 connects to the conductive wall 136 and the main transmission line 72 comprises a microstrip transmission line to wire antenna joint. This joint provides the interface between the two propagation media for the microwave radiation. The feed probe wire 140 serves the dual functions of structurally supporting the length of wire 142 and carrying microwave radiation to and from the length of wire 142. The feed probe wire 140 may be secured in the feed-through hole 134 by means of soldering.

The antenna 52 also includes an extension wire 144 which is coupled to the other end of the length of wire 142. The extension wire 144 has a length which is generally, but not necessarily, shorter than the distance 146 between the plane of the length of wire 142 and the ground plane 74. Because the extension wire 144 has one end that is left open, the length of wire 142 is fed by only a single transmission line, namely, the main transmission line 72 which feeds the feed probe wire 140.

The extension wire 144 shown in FIGS. 8 and 9 extends parallel to the feed probe wire 140 and towards the ground plane 74 without making contact thereto. The reason for this parallel relationship is that the antenna 52 will have good geometric symmetry which will result in a radiation pattern having good definition and symmetry. For impedance matching purposes, however, the geometry of the extension wire 144 is not important; the extension wire 144 may extend in any direction.

A brace 162 and a support 164 (See FIG. 12) are envisioned to add mechanical rigidity to the length of wire 142. Although they are not required, the brace 162 may be inserted between the feed probe wire 140 and the extension wire 144, and the support 164 may be positioned between the length of wire 142 and the ground plane 74 directly across the length of wire 142 from the brace 162. The brace 162 and support 164 should be designed such that they will not significantly affect the tuning of the antenna 52.

Maximum power will be transferred from the planar microwave transceiver 50 to the antenna 52 if the impedance of the main transmission line 72 is matched to the input impedance of the antenna 52. Although impedance matching is achieved by adjusting several variables associated with the antenna 52, one of the dominant variables is the distance 146 between the length of wire 142 and the conductive ground plane 74. The distance 146 is a dominant variable because the conductive ground plane 74 serves as a reflective surface for the antenna 52. A reflective surface facilitates impedance matching and increases the directivity of an antenna. While the use of a reflective surface to achieve impedance matching is well known in the art, a very unique feature of the antenna 52 is that it utilizes the conductive ground plane 74 as a reflective surface. This is unique because the conductive ground plane 74 is the same conductive ground plane which is employed by the microstrip lines of the planar microwave transceiver 50. Thus, the planar microwave transceiver 50 "shares" its microstrip ground plane 74 with the antenna 52.

The variables that are adjusted in order to match the impedance of the antenna 52 to the main transmission line 72 include the length of the length of wire 142, the distance 146 between the plane of the length of wire 142 and the ground plane 74, the addition and length of the feed probe wire 140, and the addition and length of the extension wire 144. The length of the length of wire 142 and the distance 146 are initially chosen using standard loop antenna theory and assuming that a balanced twin line feed is used. The values are chosen so that the input impedance of the antenna 52 will be about 50 ohms with a nearly zero reactive component which will provide an optimized match to the 50 ohm main transmission line 72. The feed probe wire 140 and extension wire 144 are then added to compensate for the fact that a balanced twin line feed is not used.

As mentioned earlier, a standard loop antenna which is fed by a balanced twin line feed will have a current maximum at its input terminals if the length of the wire loop is about equal to 1.0 wavelength of the generated radiation. The presence of a current maximum at the input terminals will facilitate impedance matching. A standard loop antenna having a wire loop which has a length of 1.0 wavelength yields a theoretical directivity of about 3.5 dB, while maintaining a relatively low and nearly purely resistive input impedance of about 100 ohms. If the length of the wire loop is increased to about 1.1 wavelengths, then the theoretical directivity increases to about 4.0 dB, but the input impedance, which is still nearly purely resistive, increases to about 150 ohms. While a 1.1 wavelengths wire loop presents a higher input impedance than a 1.0 wavelength wire loop (for a standard loop antenna fed with a balanced twin line feed), it turns out that 1.1 wavelengths is an ideal length for the length of wire 142 of the antenna 52. The additional 0.1 wavelength facilitates impedance matching, as will be illustrated below. While 1.1 wavelengths is an ideal length, it is believed that a length of wire 142 having a length falling in the range 0.9 to 1.3 wavelengths can be impedance matched to the main transmission line 72 using the techniques of the present invention.

The directivity of a standard loop antenna is increased by placing the wire loop over a reflective surface. Furthermore, the presence of the reflective surface decreases the resistive part of the input impedance of the wire loop. Thus, a wire loop has a free space input impedance, i.e., the impedance of a wire loop in the absence of a reflective surface, and a reflector input impedance, i.e., the impedance of a wire loop when a reflective surface is present. The distance between the plane of the wire loop and the reflective surface is normally selected so that the reflector input impedance is less than the free space input impedance. A reflective surface will have these effects on a wire loop whether or not the wire loop is fed with a balanced twin line feed. In order to choose an initial distance for the distance 176, however, assume that a standard loop antenna that is fed with a balanced twin line feed and that has a 1.1 wavelength wire loop is positioned above a 0.5 wavelength square reflective surface. If the wire loop is spaced 0.08 wavelengths from the reflective surface, the directivity will increase to about 8 dB, and the input impedance will be nearly purely resistive and only 50 ohms. Because this 50 ohm impedance will provide a perfect match to the 50 ohm main transmission line 72, the distance 146 between the plane of the length of wire 142 and the ground plane 74 is chosen to be about 0.08 wavelengths of the generated radiation. While 0.08 wavelengths is an ideal distance, it is believed that a distance falling in the range of 0.01 to 0.2 wavelengths may be used to properly match the impedance of the antenna 52 to the main transmission line 72. Furthermore, the size of the ground plane 74, and thus the dielectric material 76, is chosen to be generally, but not necessarily, 0.5 wavelengths square or greater. Ground plane sizes less than 0.5 wavelengths square will significantly reduce the directivity of the antenna 52.

FIG. 10(*a*), which is nearly identical to FIG. 6(*b*), illustrates a waveform 148 of the current which flows in the length of wire 142 when it is fed with a balanced twin line feed and when it has wire loop length and ground plane spacing values similar to those chosen above. As can be seen, there is a current maximum at the input terminals, and thus, according to the chosen values of wire loop length and ground plane spacing, the input impedance is about 50 ohms.

FIG. 10(*b*), which is nearly identical to FIG. 7(*b*), illustrates a waveform 150 of the current which flows in the length of wire 142 when it is fed with unbalanced single line main transmission line 72. In other words, FIG. 10(*b*) illustrates the effect of having one terminal of the length of wire 142 open circuited. As can be seen, a current minimum exists at the input terminal which dramatically increases the input impedance above the desired 50 ohms.

FIG. 10(*c*) illustrates the effect of adding the feed probe wire 140 to the length of wire 142. Since the distance 146 between the plane of the length of wire 142 and the ground plane 74 is about 0.08 wavelengths, the feed probe wire 140 must be slightly longer than 0.08 wavelengths so that it can be secured into the feed through hole 134. As can be seen in FIG. 10(*c*), the feed probe wire 140 shifts a current maximum of the waveform about 0.08 wavelengths or more towards the end of the feed probe wire 140 where it connects to the main transmission line 72.

FIG. 10(*d*) illustrates the effect of adding the extension wire 144 to the length of wire 142. Because the extension wire 144 does not make contact with the ground plane 74, it has a length slightly less than 0.08 wavelengths. As FIG. 10(*d*) illustrates, the extension wire 144 further shifts a current maximum of the waveform 156 towards the end of the feed probe wire 140 where it makes contact with the main transmission line 72.

Because the current illustrated by the waveform 156 is near a maximum point at the end of the feed probe wire 140 where it makes contact with the main transmission line 72, the input impedance of the feed probe wire 140 will be about 50 ohms. This results in the feed probe wire 140 being matched to the 50 ohm main transmission line 72, and therefore, maximum energy will be transferred to the antenna 52.

While the dominant factors used to impedance match and achieve a resonant condition are the length of the length of wire 142, the length of the feed probe 140 and extension 144 wires, and the distance 146 between the length of wire 142 and the ground plane 74, there are several other factors which may influence the impedance match. Two of these other factors are discussed immediately below. It is difficult to give an explanation of the exact effect each of these additional factors has on the impedance of the antenna 52. While a preferred range of dimensions is given for each factor, the best known way to adjust them for various applications is to perform an empirical analysis on a network analyzer.

The first one of these other factors is the spacing between the feed probe wire 140 and the extension wire 144. There is a slight coupling which occurs here which can be controlled by the spacing. The spacing between these two wires is best chosen such that the capacitive coupling between the wires is minimized. A preferred spacing is greater than two times the feed probe wire 140 diameter.

Another factor is the capacitance which occurs between the open end of the extension wire 144 and the ground plane 74. This capacitance can be controlled by the spacing of the open end of the extension wire 144 from the ground plane 74. While this capacitance can be used as a tuning mechanism, it is best to minimize this capacitance in order to simplify the impedance matching of the antenna 52. A preferred spacing of the end of the extension wire 144 from the ground plane 74 is greater than the extension wire 144 diameter.

The polarization of the electrical field in a standard loop antenna which is fed with a balanced twin line feed is directed across the current nodes, which are orthogonal to the balanced feed point. Because the antenna 52 does not necessarily have current nodes that are orthogonal to the feed probe wire 140, the polarization of the electric field will be rotated from that of the standard loop antenna, as shown in FIG. 10(*d*).

Figure 13:
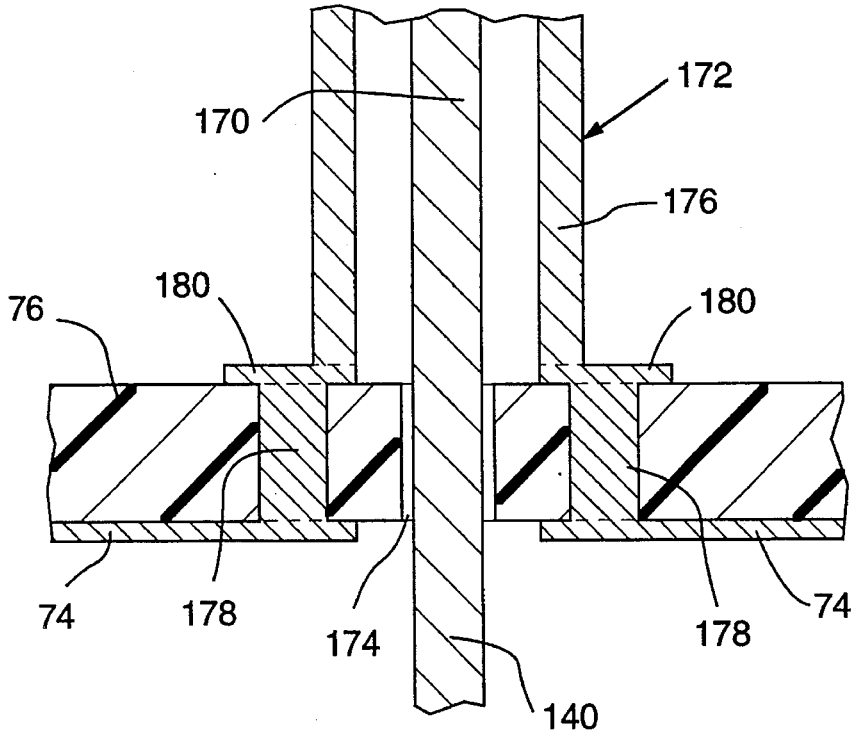
FIG. 13 is an expanded cross-sectional view of an alternative embodiment of the antenna of the present invention.

By using the above method of impedance matching, the antenna 52 can similarly be impedance matched to nearly any type of single line transmission line, such as microstrip, strip line, or the center conductor of a coaxial line. FIG. 13 illustrates the manner in which the center conductor 170 of a coaxial line 172 may be connected to the antenna 52. A hole 174 in the ground plane 74 and the dielectric material 76 allows the center conductor 170 to pass therethrough and be coupled to the feed probe wire 140. As shown in FIG. 13, the feed probe wire 140 may be a continuation of the center conductor 170. The outer conductor 176 of the coaxial line 172 should be coupled to the ground plane 74. This coupling may be accomplished by one or more via holes 178 similar to the via holes 99 shown in FIG. 4.

Figure 11:
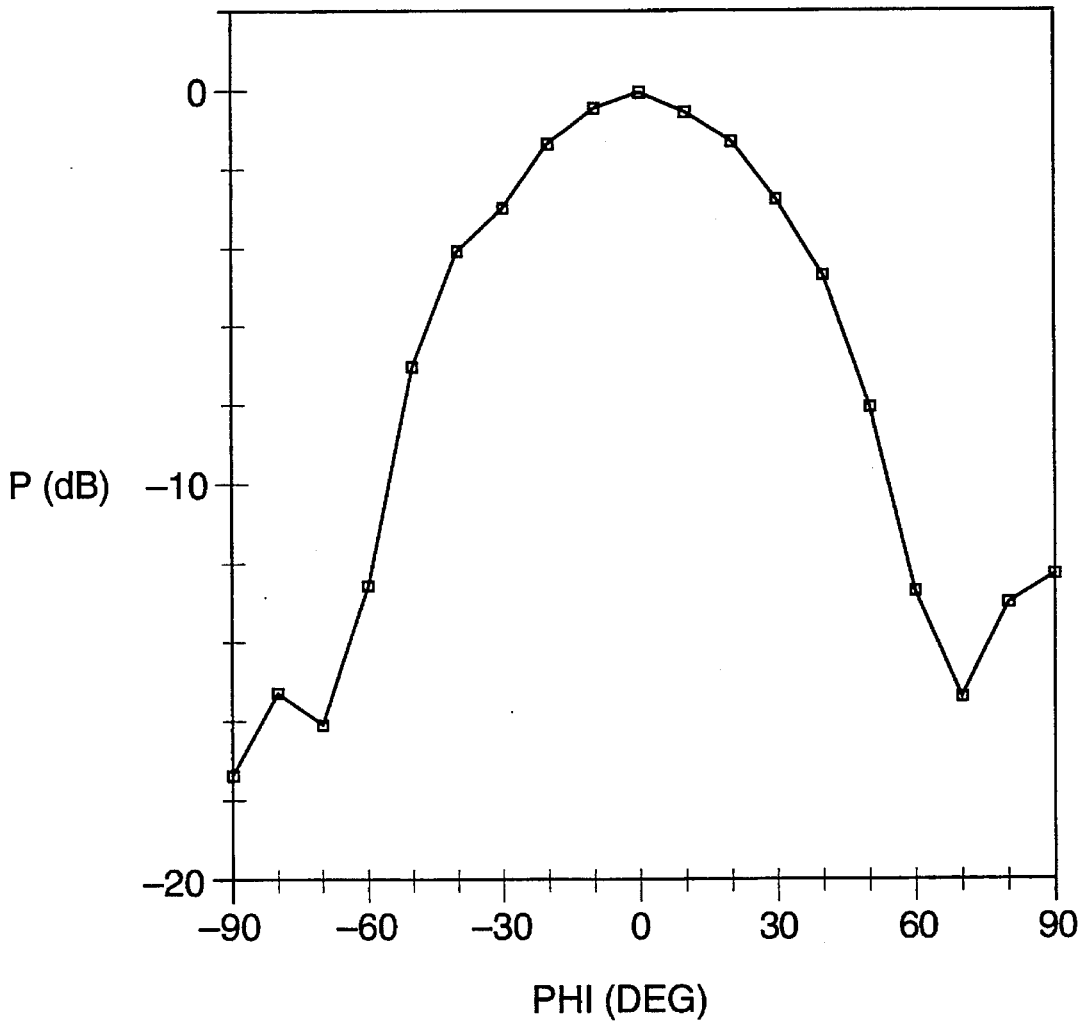
FIG. 11 is a typical E-plane electric field pattern of the antenna of the present invention.

FIG. 11 illustrates a typical E-plane electric field radiation pattern for the antenna 52. The strength of the radiated microwave radiation is shown as a function of the number of degrees that the detected object is off the center of the antenna 52.

Figure 12B:
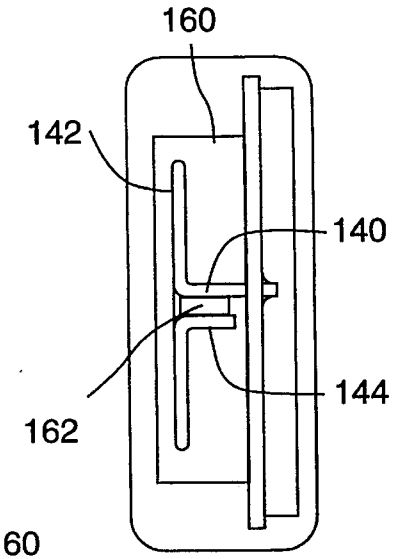
FIGS. 12(*a*), 12(*b*) and 12(*c*) are a top, end, and side view, respectively, of a housing for the planar microwave transceiver and antenna of the present invention.
Figure 12A:
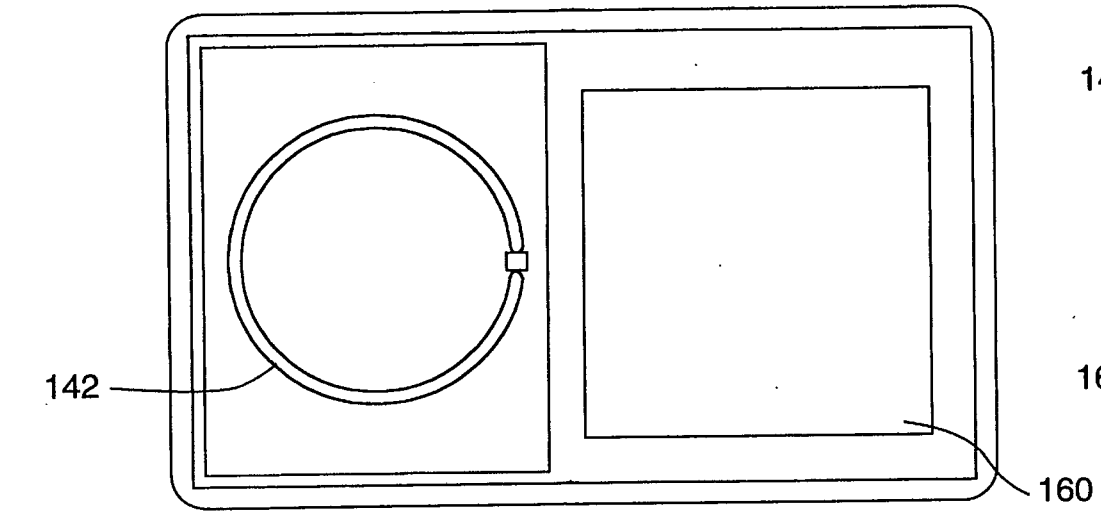
Figure 12C:
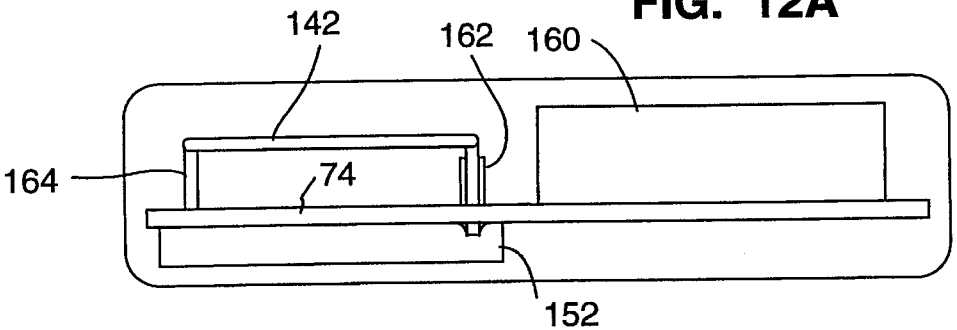

FIG. 12 illustrates the front, side, and end views of a plastic housing 158 used for containing the planar microwave transceiver 50 and the microwave antenna 52. The housing 158 is constructed from 0.090 inch thick polystyrene material, and its dimensions are illustrated in the FIG. 12. The housing 158 is spaced about 0.25 inches away from the antenna 52. The resonant frequency of the antenna 52 is lowered slightly by the proximity of the housing 158. In practice, to compensate for this effect, the antenna 52 is designed to be matched to the main transmission line 72 at a frequency slightly higher than the desired operating frequency. The actual amount of frequency shift caused by the housing 158 is generally determined empirically with the aid of a network analyzer. For example, in one embodiment if the antenna 52, without the housing 158, is designed to be matched to the main transmission line 72 at a frequency of 2.476 GHz, when the housing 158 is added the resonant frequency of the antenna 52 will be lowered such that it will match to the main transmission line 72 at a frequency of 2.450 GHz.

The planar microwave transceiver 50 and the antenna 52 occupy only about one-half of the plastic housing 158. The other one-half of the plastic housing 158 is for mounting a passive infrared intrusion detector system 160 which detects the presence and/or motion of infrared radiation within a defined area. The combination of an active microwave detector and a passive infrared detector can be found in the DualTec® intrusion detection system manufactured by C & K Systems, Inc., of Folsom, Calif., the assignee of the subject application.

The microwave antenna 52 shown in FIGS. 8 and 9 was described in the parent application cross-referenced above. The present invention provides several improvements to the antenna 52.

Figure 14:
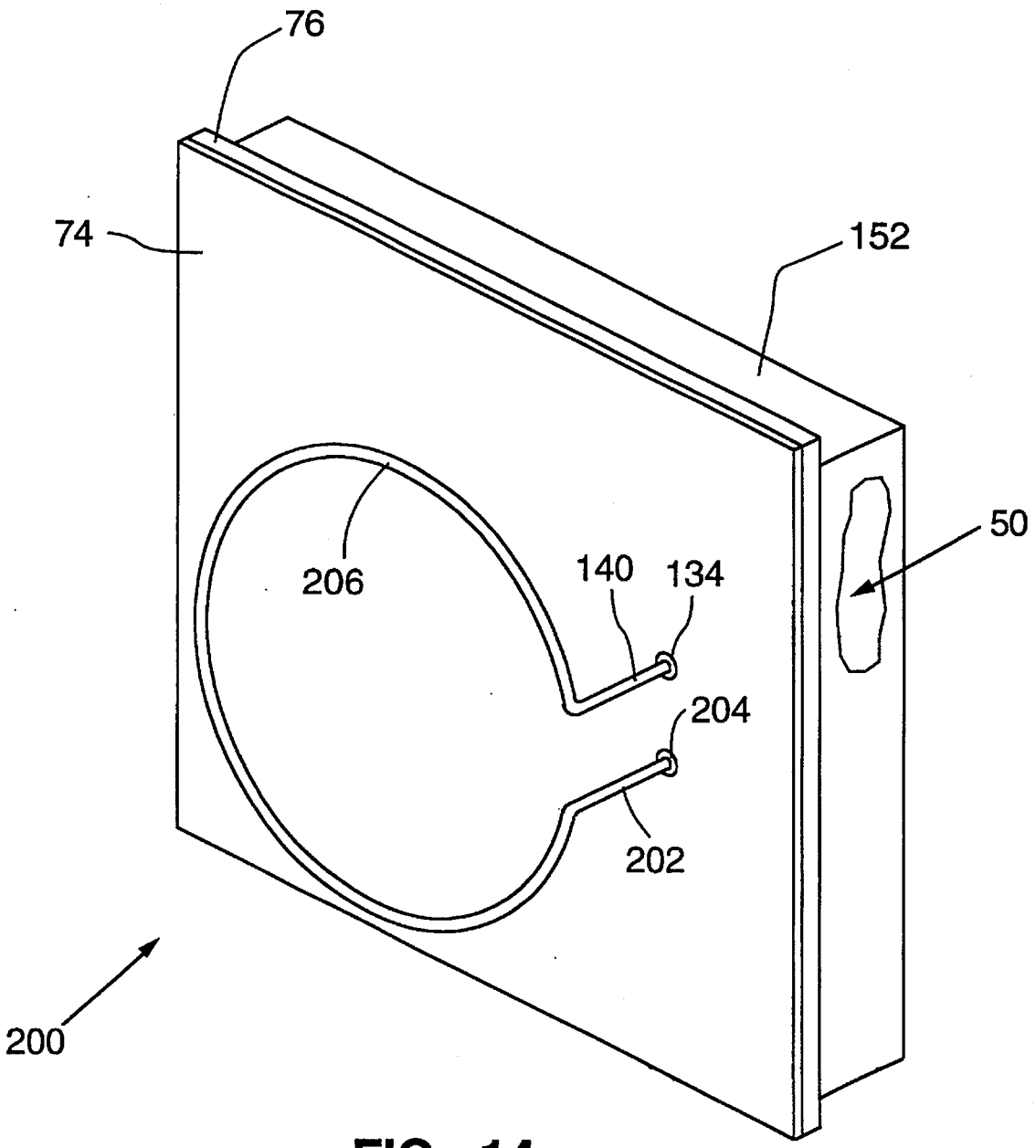
FIG. 14 is a perspective view illustrating a microwave antenna in accordance with the present invention.

Referring to FIG. 14, there is illustrated a microwave antenna 200 in accordance with the present invention. The antenna 200 is substantially similar in design as the antenna 52 shown in FIG. 8 except that the formerly open circuit extension wire 144 is now terminated in a short circuit via a shorting wire 202. Specifically, the shorting wire 202 is connected to the conductive ground plane 74 by means of a feed-through via hole 204.

The shorting wire 202 of the antenna 200 provides an electrical path to ground for static charge. This grounding provides for improved static protection of the receiver (mixer) circuit 58 that is discussed above with reference made to FIGS. 2 through 4. The diode 122 used in the mixer circuit 58 is known to be static sensitive.

Figure 15A:
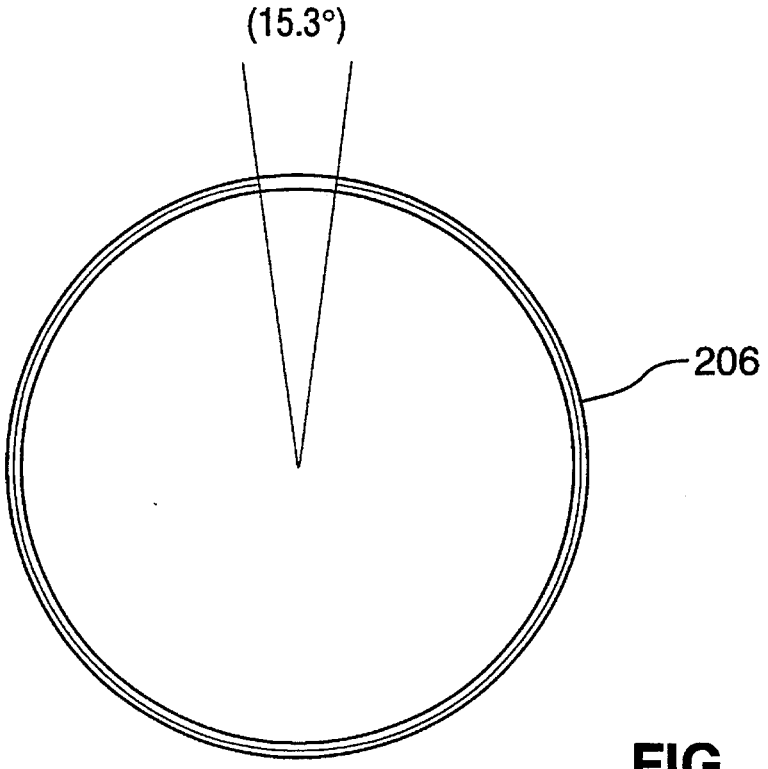
FIGS. 15(*a*) and 15(*b*) are top and side views illustrating the length of wire of the antenna shown in FIG. 14.
Figure 15B:
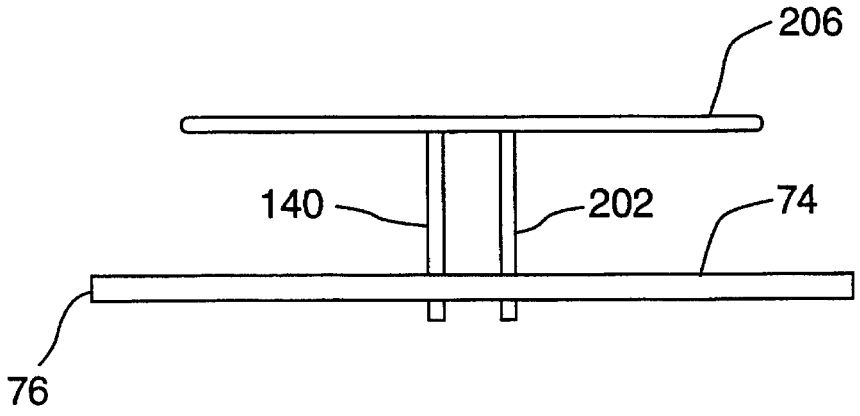

Referring to FIG. 15, in addition to improved static protection, the antenna 200 also includes the advantage that it is more mechanically stable than the open ended antenna 52. This improved mechanical rigidity is due to the length of wire 206 being physically connected to the dielectric material 76 at both ends 140 and 202. As shown in FIG. 15, the loop formed by the length of wire 206 preferably has a diameter of 1.500 inches and is spaced apart from the conductive ground plane 74 by 0.400 inches. The feed probe wire 140 and the shorting wire 202 preferably each have a length of 0.500 inches and are spaced apart from each other by 0.200 inches. Such spacing between the feed probe wire 140 and the shorting wire 202 forms a 15.3° angle therebetween when measured from the center of the loop 206.

The technique used to match the input impedance of the open loop wire antenna 52 to the 50Ω main transmission line 72 was discussed above using the waveforms shown in FIGS. 10A through 10D. In that discussion it was explained that if a high current is present at the input terminals of the antenna 52, then the input impedance will be lower than if a low current is present at the input terminals. Because the main transmission line 72 has a fairly low impedance, i.e., 50Ω, a solution was presented in FIG. 10D which maintains a high current at the feed point of the antenna 52 in order to decrease the input impedance. The solution involved adding the extension wire 144 to the end of the length of wire 142 in order to move the waveform 156 farther along the length of wire 142 in order to position a near maximum point of the waveform 156 at the input of the feed probe wire 140.

Figure 10A:
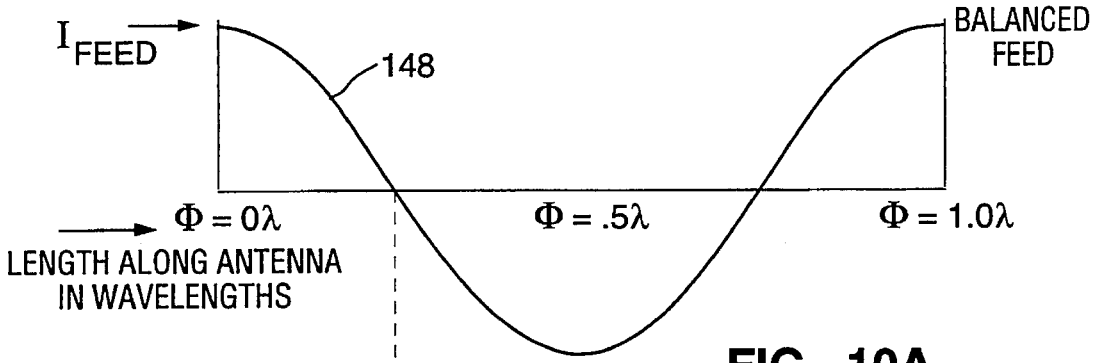
FIGS. 10(*a*)–10(*d*) are a series of waveforms of the current which flows in the antenna of the present invention.
Figure 10B:
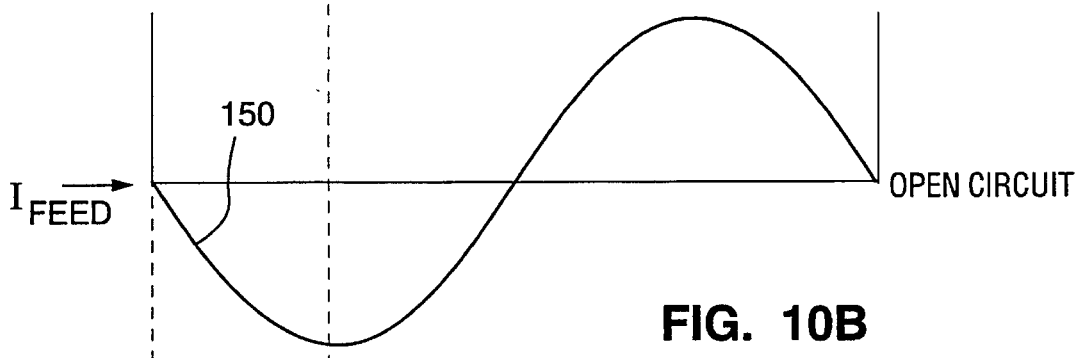
Figure 10C:
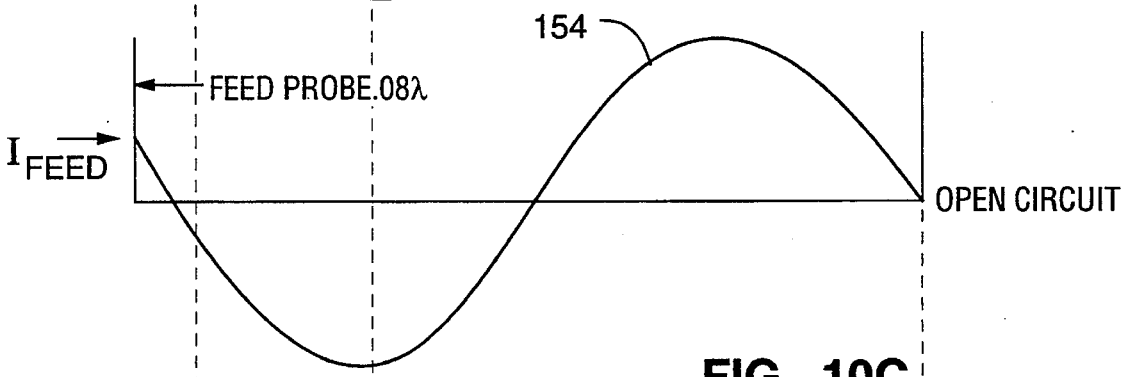
Figure 10D:
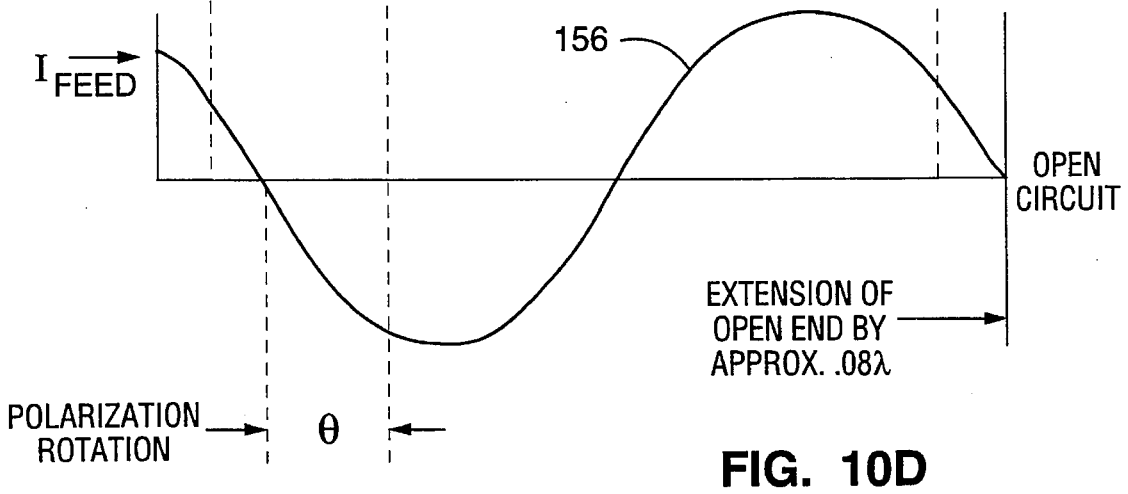
Figure 16A:
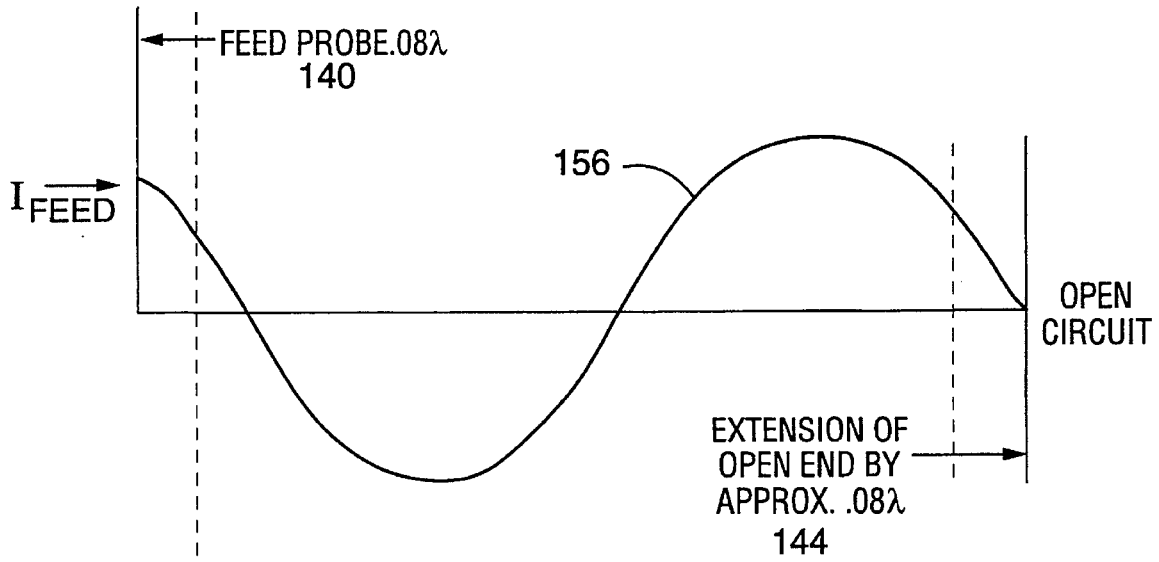
FIGS. 16A and 16B are waveforms illustrating the current which flows in the antennas shown in FIGS. 8 and 14, respectively.

FIG. 10D is reproduced in FIG. 16A. Referring to the waveform 208 in FIG. 16B, it can be seen that another possible solution for maintaining a high current at the feed point of the antenna 200 is to insert a short circuit in the length of wire 206 at the maximum current point which is approximately one-quarter wavelength from the open circuit point in the waveform 156. The length of wire 206 is shorted to the conductive ground plane 74 by the shorting wire 202. Because the end of the length of wire 206 is shorted to the ground plane 74 at a maximum point in the waveform 208, the waveform 208 does not move along the wire 206 as it does when the open circuit is moved. Thus, a near maximum point in the current waveform 208 remains at the input of the feed probe wire 140.

In the antenna 52 shown in FIG. 8, the various parameters of the antenna 52, such as the loop 142 length and the spacing above the ground plane 74, were varied until an input impedance of 50Ω+j0Ω was obtained. As previously described, the power transfer from the 50Ω main transmission line 72 is maximized under this condition.

For the antenna 200, however, a purely resistive input impedance at the feed probe wire 140 is not realizable due to the other end 202 being shorted to the conductive ground plane 74. Because the antenna 200's input impedance has an imaginary component, a matching network is used to offset the imaginary component in order to match the input impedance of the antenna 200 to the 50Ω main transmission line 72.

Specifically, the input impedance of the antenna 200 is matched to the main transmission line 72 by first varying the parameters of the antenna 200 (i.e., the loop 206 length and the spacing above the ground plan 74) until an input impedance is obtained which is easily matched to the 50Ω main transmission line 72 with a matching network. Such an input impedance that is easily matched with a matching network is approximately 30Ω+j30Ω.

Figure 17:
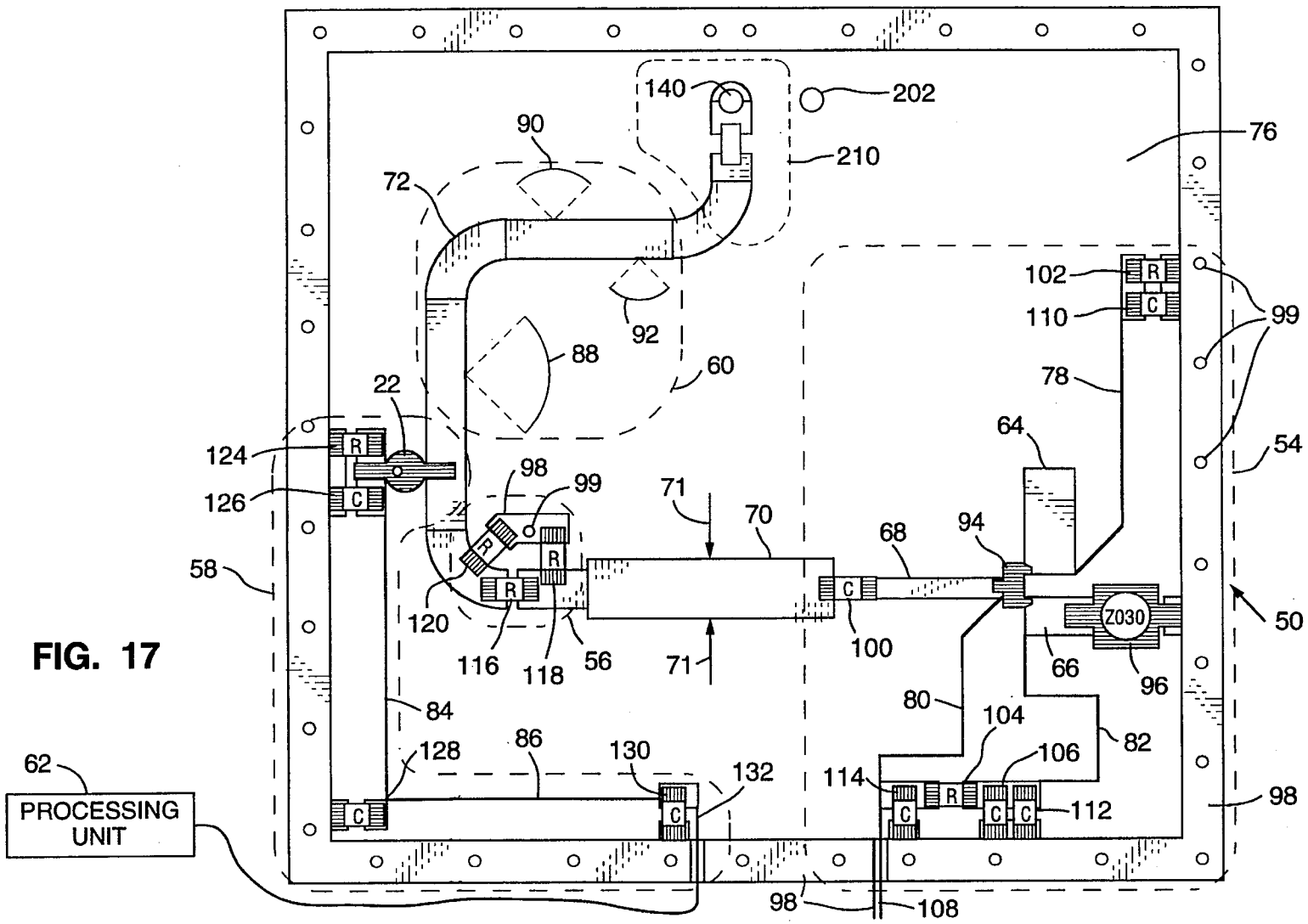
FIG. 17 is an approximately three to one blow-up of a printed circuit board layout of a preferred embodiment of a planar microwave transceiver in accordance with the present invention.
Figure 18:
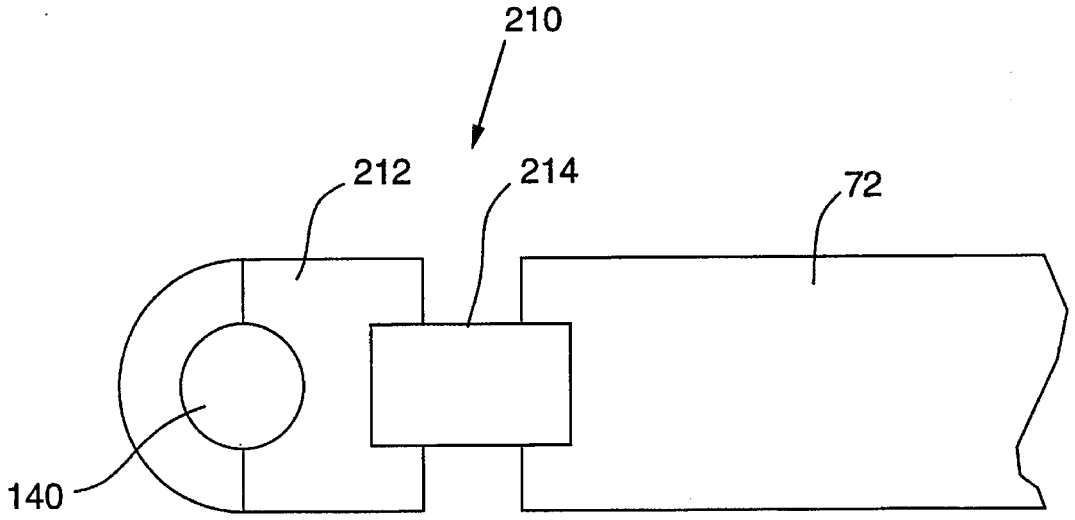
FIG. 18 is schematic diagram illustrating a matching network for use with the antenna shown in FIG. 14.

Referring to FIGS. 17 and 18, a matching network 210 that may be used to match the 30Ω+j30Ω impedance to the 50Ω main transmission line 72 includes a length of microstrip line 212 and a series capacitor 214. The length of microstrip line 212 transforms the antenna's 200 input impedance to approximately 50Ω+j70Ω. The series capacitor 214 offsets the resultant imaginary component, i.e., +j70Ω, of the transformed impedance, resulting in an impedance which is purely real, i.e., 50Ω, so that a match is obtained.

The length of microstrip line 212 preferably has a width of 100 mil and a length of 70 mil, and the material used for the length of microstrip line 212 preferably has a dielectric constant of 4.7, a thickness of 0.062 inches, and is plated with 0.0014 inches of copper. The series capacitor 214 is preferably a 1.2 pF chip capacitor.

The matching network 210, which is well known in the art, is only one of a variety of techniques that can be used to match the input impedance of the antenna 200 to the 50Ωmain transmission line 72. Although it should be understood that many other matching techniques may be used, the matching network 210 is believed to provide the smallest physical matching network.

Figure 19A:
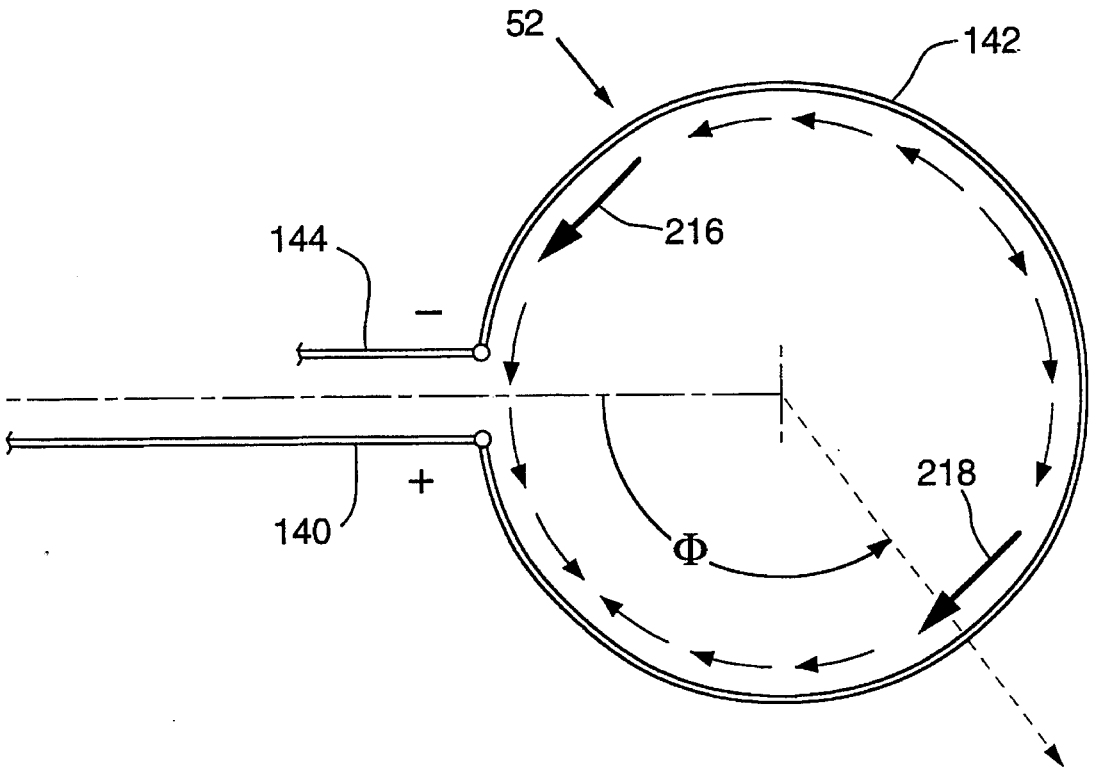
FIGS. 19A and 19B are diagrams illustrating the direction of current flow in the antennas shown in FIGS. 8 and 14, respectively.

The antenna 200 has improved antenna pattern symmetry in its radiated pattern over the antenna 52 shown in FIGS. 8 and 9. With respect to the antenna 52, FIG. 19A illustrates the direction of the current flow in the length of wire 142. The arrows 216 and 218 indicate the positions of the current maximums, or primary radiating elements, in the length of wire 142 which correspond to the maximums in the waveform 156 shown in FIG. 16A. As mentioned above, it is desireable for a current maximum to be positioned at the input of the length of wire 142, i.e., at the feed probe wire 140. But as FIG. 19A illustrates, the current maximum indicated by the arrow 216 is rotated by approximately 30° to 45° away from the feed probe wire 140. Although the current present at the feed probe wire 140 is still fairly large, it is not the maximum current in the waveform 156.

Figure 19B:
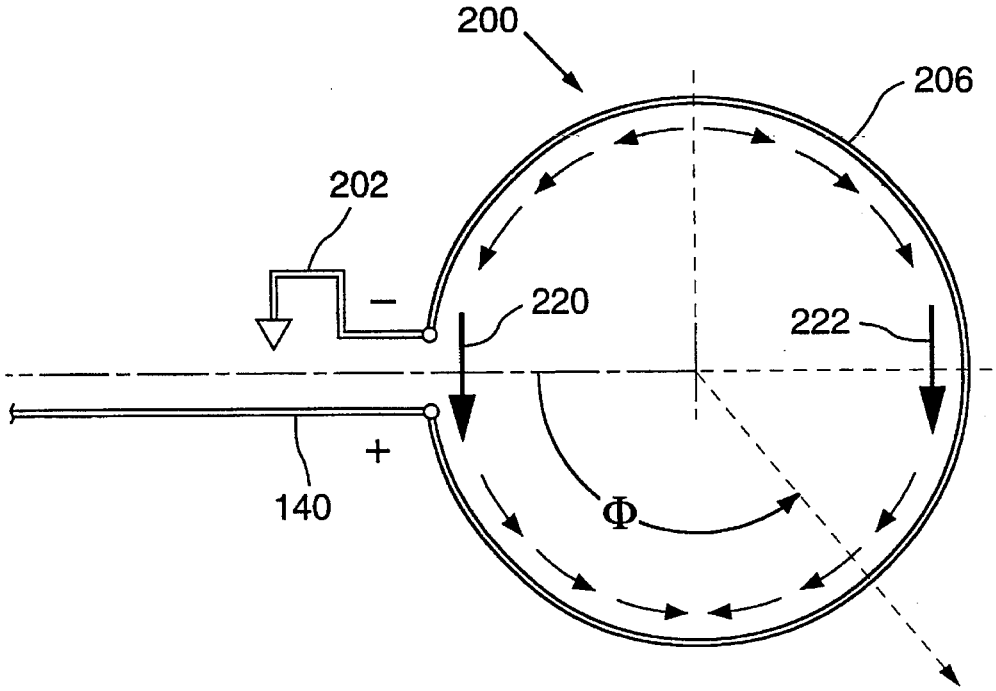

FIG. 19B illustrates the direction of current flow in the length of wire 206 of the antenna 200. The arrows 220 and 222 indicate the positions of the current maximums, or primary radiating elements, in the length of wire 206 which correspond to the maximums in the waveform 208 shown in FIG. 16B. By adjusting the loop 206 length and the spacing above the ground plan 74, the current maximum indicated by the arrow 220 can be positioned closer to the feed probe wire 140 than in the antenna 52. This positioning causes the current distribution in the length of wire 206 of the antenna 200 to be more symmetric than in the length of wire 142 of the antenna 52. Therefore, the radiated pattern, being mathematically related to the current distribution, is more symmetric.

An additional advantage of the radiation pattern of the antenna 200 is that the current maximum indicated by the arrow 222 is located directly opposite the feed point. At this current maximum, the voltage is nearly zero. Therefore, a supportive plastic post may be added to the length of wire 206 at this point to improve the mechanical rigidity with no effect upon the antenna 200's performance. The open circuited antenna 52 provided mechanical attachment points as well, but these locations were not symmetrically positioned; thus, two posts were required to secure the antenna 52.

Figure 16B:
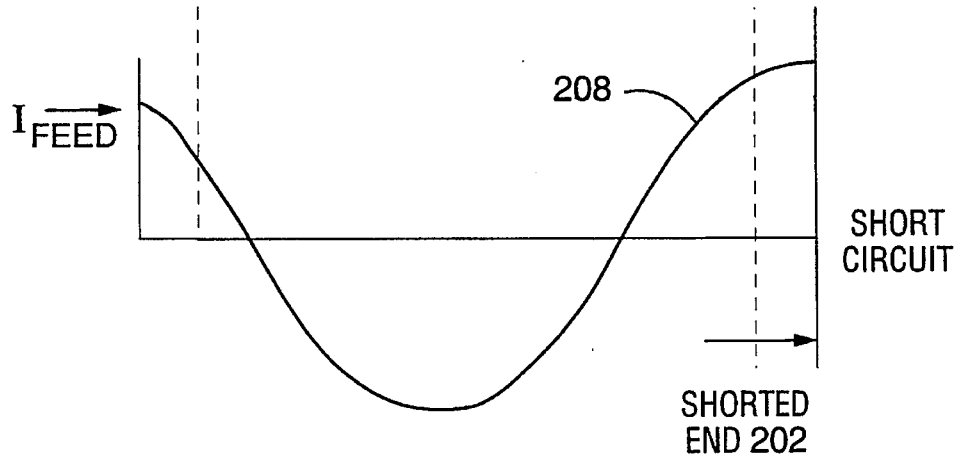

In comparing the waveform 156 of FIG. 16A with the waveform 208 of FIG. 16B, it can be seen that the length of wire 206 of the antenna 200 has an overall length which is less than the length of wire 142 of the antenna 52. This shorter length provides for a physically smaller antenna 200 when the length of wire 206 is arranged in the form of a loop. A smaller form factor permits the antenna 200 to be contained in a smaller housing.

It should be understood that various alternatives to the embodiments of the invention described herein may be employed in practicing the invention. It is intended that the following claims define the scope of the invention and that structures and methods within the scope of these claims and their equivalents be covered thereby.

What is claimed is:

1. An antenna for radiating and collecting electromagnetic radiation, comprising:

a substantially planar conductive member having a first side and a second side;

a strip conductor positioned to said first side of said conductive member and substantially parallel thereto;

a dielectric material sandwiched between said strip conductor and said conductive member;

a length of wire for radiating and collecting microwave electromagnetic radiation, said length of wire having a first end and a second end and lying substantially in a plane which is positioned to said second side of said conductive member and substantially parallel thereto, said length of wire spaced apart a distance from said conductive member;

a feed probe wire connecting said first end of said length of wire to said strip conductor, said feed probe wire extending through said conductive member and through said dielectric material; and a shorting wire coupling said second end of said length of wire to said conductive member.

2. The antenna of claim 1, further comprising:

a matching network for coupling said feed probe wire to said strip conductor.

3. The antenna of claim 2, wherein said matching network comprises:

a length of microstrip line;

a capacitor; and wherein, said length of microstrip line and said capacitor are connected in series and said feed probe wire is coupled to said strip conductor through said series connected length of microstrip line and capacitor.

4. The antenna of claim 3, wherein said capacitor has a value of approximately 1.2 pico Farads.

5. The antenna of claim 1, wherein said antenna is used for radiating electromagnetic radiation having a predetermined wavelength, and wherein said length of wire has a length equal to between 0.9 and 1.3 multiplied by said predetermined wavelength.

6. The antenna of claim 1, wherein said antenna is used for radiating electromagnetic radiation having a predetermined wavelength, and wherein said distance between said plane of said length of wire and said conductive member is between 0.01 and 0.2 multiplied by said predetermined wavelength.

7. The antenna of claim 1, wherein said length of wire has a loop shape.

8. The antenna of claim 1, further comprising:

generator means, coupled to said strip conductor, for generating and delivering electromagnetic energy to said strip conductor for transmission at a transmission frequency; and receiver means, coupled to said strip conductor, for receiving electromagnetic energy from said strip conductor.

9. The antenna of claim 8, wherein said generator means generates and said receiver means receives electromagnetic radiation that lies substantially within the microwave frequency range of the electromagnetic spectrum.

10. A microwave intrusion detection system, comprising:

a substantially conductive member having two sides;

transceiver means for generating and receiving microwave electromagnetic energy positioned to one side of said conductive member;

an antenna having a length of wire positioned on the other side of said conductive member for radiating and collecting microwave electromagnetic radiation, said length of wire having a first end and a second end and lying in a plane which is substantially parallel to said conductive member so that said conductive member forms a reflecting means for said antenna, said antenna having a shorting wire connecting said length of wire second end to said substantially conductive member and a feed probe wire connected to said length of wire first end; and transmission line means for transmitting and receiving microwave electromagnetic energy from said transceiver means to and from said antenna, said transmission line means having a strip conductor positioned substantially to said one side of said conductive member and substantially parallel thereto, and a dielectric material between said strip conductor and said conductive member.

11. The microwave intrusion detection system of claim 10, wherein said transceiver means comprises:

generator means, coupled to said transmission line means, for generating and delivering microwave electromagnetic energy to said transmission line means; and receiver means, coupled to said transmission line means, for receiving collected microwave electromagnetic energy from said antenna and for receiving generated microwave electromagnetic energy from said transmission line means.

12. The microwave intrusion detection system of claim 11, wherein said generator means comprises a silicon bipolar transistor.

13. The microwave intrusion detection system of claim 11, wherein said receiver means comprises a Schottky-barrier diode.

14. The microwave intrusion detection system of claim 10, wherein the generated microwave electromagnetic energy includes harmonic frequencies, said transceiver means further comprising:

a filter means for substantially shunting to ground reference the harmonic frequencies of the generated electromagnetic energy.

15. The microwave intrusion detection system of claim 14, wherein said filter means comprises a lowpass structure having a radial open planar stub.

16. The microwave intrusion detection system of claim 11, wherein said transceiver means further comprises:

attenuator means for attenuating energy propagating between said generator means and said receiver means by a selected amount.

17. The microwave intrusion detection system of claim 16, wherein said attenuator means comprises a resistive pi-network.

18. The microwave intrusion detection system claim 10, wherein said length of wire comprises a loop shape.

19. The microwave intrusion detection system of claim 10, further comprising:

processing means, coupled to said transceiver means, for processing said received microwave electromagnetic energy into an electrical signal indicative of a detection of an intrusion.

20. A microwave antenna, comprising:

a substantially planar substantially conductive member having a first side and a second side;

a length of wire for radiating and collecting microwave electromagnetic radiation, said length of wire having a first end and a second end and lying substantially in a plane which is substantially parallel to said conductive member and spaced apart a distance from said first side of said conductive member, whereby said conductive member reflects microwave electromagnetic radiation radiated from said length of wire;

a feed probe wire having a first end thereof connected to said first end of said length of wire, said feed probe wire extending through said conductive member; and a shorting wire coupling said second end of said length of wire to said conductive member.

21. The microwave antenna of claim 20, further comprising:

a coaxial cable having a center conductor which is coupled to a second end of said feed probe wire, said coaxial cable positioned to a second side of said conductive member.

22. The microwave antenna of claim 20, further comprising:

a strip conductor positioned on said second side of said conductive member and substantially parallel thereto;

a dielectric material sandwiched between said strip conductor and said conductive member.

23. A microwave antenna, comprising:

a strip conductor transmission line having a conductive ground plane positioned spaced apart and substantially parallel to said strip conductor transmission line and having a dielectric material sandwiched therebetween; and a length of wire having a first end connected to a feed probe wire which is connected to said strip conductor transmission line and a second end coupled to said conductive ground plane, said length of wire for radiating and collecting electromagnetic radiation, wherein said wire lies substantially in a plane which is substantially parallel to said ground plane of said strip conductor, said length of wire sharing said ground plane with said strip conductor by being positioned spaced apart a distance from said ground plane such that said ground plane is capable of reflecting electromagnetic radiation radiated by said wire, whereby said ground plane functions as a ground plane for said strip conductor and as a reflector for said length of wire.

24. The microwave antenna of claim 23, further comprising:

a feed probe wire for coupling said first end of said length of wire to said strip conductor transmission line, said feed probe wire extending through said ground plane; and a shorting wire for coupling said second end of said length of wire to said conductive ground plane.

25. The antenna of claim 24, further comprising:

a matching network for coupling said feed probe wire to said strip conductor transmission line.

26. The antenna of claim 25, wherein said matching network comprises:

a length of microstrip line;

a capacitor; and wherein, said length of microstrip line and said capacitor are connected in series and said feed probe wire is coupled to said strip conductor transmission line through said series connected length of microstrip line and capacitor.

27. The microwave antenna of claim 23, wherein:

said length of wire has a free space input impedance and a reflector input impedance; and said distance between said plane of said length of wire and said ground plane of said transmission line is selected so that said reflector input impedance is less than said free space input impedance.

28. The microwave antenna of claim 23, wherein said length of wire has a loop shape.

29. An apparatus for transmitting and receiving electromagnetic radiation, comprising:

a microwave transceiver for transmitting and receiving electromagnetic energy, said transceiver having a piece of dielectric material sandwiched between a ground plane and a strip conductor transmission line which is substantially parallel to said ground plane, said strip conductor transmission line located on a first side of said piece of dielectric material, said strip conductor transmission line capable of carrying said transmitted and received electromagnetic energy; and a wire antenna for radiating and collecting electromagnetic radiation and having a first end and a second end, said wire antenna first end being connected to a feed probe wire which is connected to said strip conductor transmission line and said wire antenna second end being electrically coupled to said ground plane, said wire antenna positioned spaced apart from said ground plane of said transceiver, whereby said wire antenna shares said ground plane with said transceiver as a reflective surface.

30. The apparatus of claim 29, wherein said microwave transceiver comprises a planar microwave transceiver having microstrip circuit components.

31. The apparatus of claim 30, wherein said planar microwave transceiver is mounted on said first side of said dielectric material.

32. The apparatus of claim 31, wherein said planar microwave transceiver further comprises:

generator means, coupled to said strip conductor transmission line, for generating and delivering electromagnetic energy to said strip conductor transmission line for transmission at a transmission frequency and a transmission wavelength; and receiver means, coupled to said strip conductor transmission line, for receiving collected electromagnetic energy from said wire antenna and generated electromagnetic energy from said strip conductor transmission line.

33. The apparatus of claim 32, wherein said receiver means comprises a Schottky-barrier diode.

34. The apparatus of claim 32, wherein said generator means comprises a silicon bipolar transistor.

35. The apparatus of claim 29, wherein said wire antenna comprises:

a feed probe wire for electrically coupling said first end of said wire antenna to said strip conductor transmission line;

a shorting wire for electrically coupling said second end of said wire antenna to said ground plane; and wherein, said wire antenna lies substantially in a plane which is substantially parallel to said ground plane.

36. The antenna of claim 35, further comprising:

a matching network for coupling said feed probe wire to said strip conductor transmission line.

37. The antenna of claim 36, wherein said matching network comprises:

a length of microstrip line;

a capacitor; and wherein, said length of microstrip line and said capacitor are connected in series and said feed probe wire is coupled to said strip conductor transmission line through said series connected length of microstrip line and capacitor.

38. The apparatus of claim 29, wherein said wire antenna comprises a loop shape.

39. The apparatus of claim 29, wherein said apparatus is used in an intrusion detection system, said apparatus further comprising:

processing means, coupled to said microwave transceiver, for processing said received electromagnetic energy into an electrical signal indicative of a detection of intrusion.

40. A method of matching the impedance of a wire antenna to the impedance of a strip conductor transmission line, the strip conductor transmission line being spaced apart from a ground plane and having a dielectric material sandwiched therebetween, the wire antenna lying substantially in one plane and being capable of radiating and collecting electromagnetic radiation having a predetermined frequency and wavelength, comprising the steps of:

setting the length of the wire antenna initially approximately equal to one wavelength of the radiated electromagnetic radiation;

positioning the wire antenna a distance spaced apart from the ground plane of the strip conductor such that the plane of the wire antenna is substantially parallel to the ground plane;

connecting a first end of the wire antenna to the strip conductor transmission line by way of a feed probe wire, a length of microstrip transmission line, and a capacitor, the feed probe wire having a selected length and extending through the ground plane and through the dielectric material;

coupling a second end of the wire antenna to the ground plane by way of a shorting wire; and adjusting the length of the wire antenna and the distance between the ground plane and the wire antenna until the impedance of the wire antenna is matched to the impedance of the strip conductor transmission line.

41. The method of claim 40, further comprising the step of:

adjusting the length of the microstrip transmission line and the value of the capacitor until the impedance of the wire antenna is matched to the impedance of the strip conductor transmission line.

* * * * *